US012722065B2

(12) United States Patent
Drost et al.

(10) Patent No.: US 12,722,065 B2
(45) Date of Patent: Sep. 1, 2026

(54) COMBINATION BACKSTOP AND NETTING APPARATUS AND RELATED SYSTEMS AND METHODS

(71) Applicant: Musco Corporation, Oskaloosa, IA (US)

(72) Inventors: Matthew D. Drost, Oskaloosa, IA (US); Jacob W. Taylor, Oskaloosa, IA (US); Timothy J. Boyle, Oskaloosa, IA (US); Casey T. Scheidel, Ankeny, IA (US); Kevin R. Johnson, Oskaloosa, IA (US); Logan J. Bogatzke, Eddyville, IA (US); Mark A. DeJong, Oskaloosa, IA (US)

( * ) Notice: Subject to any disclaimer, the term of this patent is extended or adjusted under 35 U.S.C. 154(b) by 177 days.

(21) Appl. No.: 18/851,227

(22) PCT Filed: May 1, 2023

(86) PCT No.: PCT/US2023/020575
§ 371 (c)(1),
(2) Date: Sep. 26, 2024

(87) PCT Pub. No.: WO2023/212399
PCT Pub. Date: Nov. 2, 2023

(65) Prior Publication Data

US 2025/0213954 A1 Jul. 3, 2025

Related U.S. Application Data

(60) Provisional application No. 63/336,566, filed on Apr. 29, 2022.

(51) Int. Cl.
*A63B 71/02* (2006.01)
*A63B 71/00* (2006.01)
(Continued)

(52) U.S. Cl.
CPC ..... *A63B 71/022* (2013.01); *A63B 71/023* (2013.01); *A63B 71/0619* (2013.01);
(Continued)

(58) Field of Classification Search
CPC . A63B 71/022; A63B 71/023; A63B 71/0619; A63C 19/08
(Continued)

(56) References Cited

U.S. PATENT DOCUMENTS 4,218,047 A 8/1980 Douglas
5,307,827 A 5/1994 Haddad et al.
(Continued)

FOREIGN PATENT DOCUMENTS

CN 112891878 A 6/2021
WO 2017058749 A1 4/2017

*Primary Examiner* — Allyson N Trail
(74) *Attorney, Agent, or Firm* — Kurt J. Fugman

(57) ABSTRACT

Various backstop and netting system embodiments have at least one wall section, at least two poles, and at least two coupling sleeves that couple the wall section (and any adjoining wall sections) and the poles. Further, certain systems include a netting that extends between and is coupled to two adjacent poles and moves between a deployed position and a retracted position within a cavity of the wall section. Many exemplary implementations of these systems include a plurality of wall sections, poles, and coupling sleeves that can be easily installed in a modular fashion to create a backstop for a playing field, such as, for example, a softball or baseball field.

20 Claims, 21 Drawing Sheets

(51) Int. Cl.
*A63B 71/06* (2006.01)
*A63B 102/18* (2015.01)
*A63C 19/08* (2006.01)

(52) U.S. Cl.
CPC ..... *A63C 19/08* (2013.01); *A63B 2071/009* (2013.01); *A63B 2102/18* (2015.10); *A63C 2019/085* (2013.01)

(58) Field of Classification Search
USPC ..... 473/421
See application file for complete search history.

(56) References Cited

U.S. PATENT DOCUMENTS 5,355,903 A 10/1994 Haddad et al.
6,776,733 B2 8/2004 Schroeder
6,849,009 B1 * 2/2005 Forlini ..... A63B 71/022 473/446
7,351,168 B1 * 4/2008 Pannell ..... A63B 63/004 273/400
9,017,190 B2 4/2015 Sportsfield
9,586,123 B2 3/2017 Sportsfield
10,184,264 B2 1/2019 Sunjoy
10,557,284 B2 2/2020 McMillen, Jr. et al.
10,641,003 B2 5/2020 Macias
12,286,273 B1 * 4/2025 Sherman ..... A01G 20/47
2003/0181264 A1 * 9/2003 Yoon ..... A63B 71/023 473/421
2007/0021241 A1 1/2007 Geller et al.
2015/0024877 A1 * 1/2015 Cowan ..... A63B 63/004 473/478
2015/0251073 A1 9/2015 Hulbert
2017/0173431 A1 * 6/2017 Rigoli ..... A63B 63/004
2017/0234030 A1 8/2017 Macia
2019/0315609 A1 10/2019 Myrland
2021/0025191 A1 * 1/2021 Volin ..... E04H 15/005
2022/0062726 A1 3/2022 Kapsalis
2023/0398425 A1 * 12/2023 Rigoli ..... A63B 71/022
2024/0060521 A1 * 2/2024 Wakibayashi ..... F16B 7/18
2024/0252906 A1 * 8/2024 De Spong ..... A63B 63/004

* cited by examiner

COMBINATION BACKSTOP AND NETTING APPARATUS AND RELATED SYSTEMS AND METHODS

CROSS-REFERENCE TO RELATED APPLICATION(S)

This application is a National Stage application claiming priority to and the benefit of International Patent Application No. PCT/US2023/020575, filed May 1, 2023, which claims the benefit under 35 U.S.C. § 119(e) to U.S. Provisional Application 63/336,566, filed Apr. 29, 2022 and entitled "Combination Backstop and Netting Apparatus and Related Systems and Methods," each of which are hereby incorporated herein by reference in their entirety.

FIELD

The various embodiments herein relate to sports field structures, and more specifically to backstop and netting systems for use on various types of playing fields, including softball and baseball fields.

BACKGROUND

Known methods for installation of sports backstop and netting systems are very customized and site-specific and, as a result, very labor-intensive. Typically, large swaths of netting and an excess amount of structural components (lumber, etc.) are shipped and cut and/or adjusted to size on site during installation. The customized nature of these known systems and methods typically result in slow and error-filled installations that can produce imprecise, unprofessional, and/or inconsistent backstops between fields or venues—in addition to being quite costly.

Further, while some more recent backstop systems have fewer poles (to improve lines of sight), these systems can have issues with pole integrity (e.g., in the event of wind or weather conditions weighing down netting) and fewer mounting surfaces for optional value-added devices (video cameras, speed guns, microphones, etc.).

In addition, known backstop and netting systems generally lack modularity and thus are not designed to be modified or adjusted after installation, making any subsequent modifications cumbersome and expensive. And such known systems also fail to allow for netting removal or storage, resulting in the netting being exposed to the elements until failure—which, again, adds to the cost of the system when netting must be replaced before the end of its otherwise useful life.

There is a need in the art for improved methods and systems for installation and maintenance of sports field backstop and netting systems.

BRIEF SUMMARY

Discussed herein are various backstop and netting systems and methods of installing such systems. Certain system embodiments are modular systems that are manufactured off-site and can be installed very quickly and efficiently in comparison to known systems. The backstop and netting systems herein can have coupleable wall sections and poles along with retractable netting and coupling sleeves that can be used to couple the wall sections and poles together to form the backstop.

In Example 1, a backstop and netting system comprises at last one wall section, at least two poles, at least two coupling sleeves, and at least one netting. The at least one wall section comprises a first side comprising at least one access opening defined therein, a second side, a wall cavity defined by the first and second sides, and a netting receiving space defined within the wall cavity. Each of the at least two poles comprises at least one attachment track disposed along one side of the pole and at least one attachment device slidably disposed within the attachment track. Each of the at least two coupling sleeves comprises a first wall attachment component disposed on a first side of the coupling sleeve, a second wall attachment component disposed on a second side of the coupling sleeve, and a pole receiving cavity defined within the coupling sleeve. The at least one netting is releasably attachable along opposing ends of the netting to the at least one attachment devices. Example 2 relates to the backstop and netting system of Example 1, wherein the at least one netting is moveable between a deployed position and a retracted position in which the netting is disposed within the netting receiving space.

Example 3 relates to the backstop and netting system of Example 1, further comprising a concrete pad disposed on the second side.

Example 4 relates to the backstop and netting system of Example 1, further comprising a turf attachment structure disposed on the first side.

Example 5 relates to the backstop and netting system of Example 1, wherein each wall cavity comprises at least one junction box and at least one conduit attached to the junction box.

Example 6 relates to the backstop and netting system of Example 1, wherein the at least one wall section comprises at least one padding section.

Example 7 relates to the backstop and netting system of Example 1, wherein the at least one wall section comprises at least two openings providing access to the wall cavity therein.

Example 8 relates to the backstop and netting system of Example 1, wherein each sleeve comprises at two sets of adjustable screws.

Example 9 relates to the backstop and netting system of Example 1, wherein each pole further comprises a pulley associated with each attachment track.

Example 10 relates to the backstop and netting system of Example 1, further comprising a bracket disposed on the at least two poles.

Example 11 relates to the backstop and netting system of Example 1, wherein the backstop comprises at least one corner junction formed by two at least one wall sections.

Example 12 relates to the backstop and netting system of Example 11, wherein the at least one corner junction comprises a ball return opening including a ball track and a blocking structure.

Example 13 relates to the backstop and netting system of Example 1, further comprising at least one video board disposed on at least one of the at least two poles or the at least one wall section.

In Example 14, a method of installing a backstop and netting system at a site comprises positioning at least one wall section having first and second sides, generally opposite ends, and a internal space contained therebetween and therein at a desired location at the site, forming at least two holes in a ground surface in relation to the desired location of the at least one wall section, attaching each of at least two coupling sleeves to an end of the at least one wall section such that the coupling sleeve is at least partially disposed within one of the at least two holes and at least partially extends above the ground surface, inserting each of at least two poles into an elongate cavity formed by the one of the at least two coupling sleeves when disposed within the holes, positioning each of the poles in a desired position in relation to the coupling sleeve, and fixing each of the poles in the desired position such that each pole is at least partially disposed within one of the at least two holes and at least partially extends above the ground surface.

Example 15 relates to the method of Example 14, further comprising adding a netting to the system.

Example 16 relates to the method of Example 15, further comprising adjusting the positioning of the netting such that the netting covers a desired area.

Example 17 relates to the method of Example 14, further comprising pouring concrete to form a concrete pad on a side of the backstop.

Example 18 relates to the method of Example 14, further comprising attaching additional accessories or objects to at least one bracket attached to the poles.

Example 19 relates to the method of Example 14, further comprising preparing the site for installation, wherein the site includes land.

Example 20 relates to the method of Example 19, wherein preparing the site for installation comprises grading the land at the site, setting a reference elevation pin, and marking the land as needed for placement of components.

While multiple embodiments are disclosed, still other embodiments will become apparent to those skilled in the art from the following detailed description, which shows and describes illustrative embodiments. As will be realized, the various implementations are capable of modifications in various obvious aspects, all without departing from the spirit and scope thereof. Accordingly, the drawings and detailed description are to be regarded as illustrative in nature and not restrictive.

DETAILED DESCRIPTION

Figure 1A:
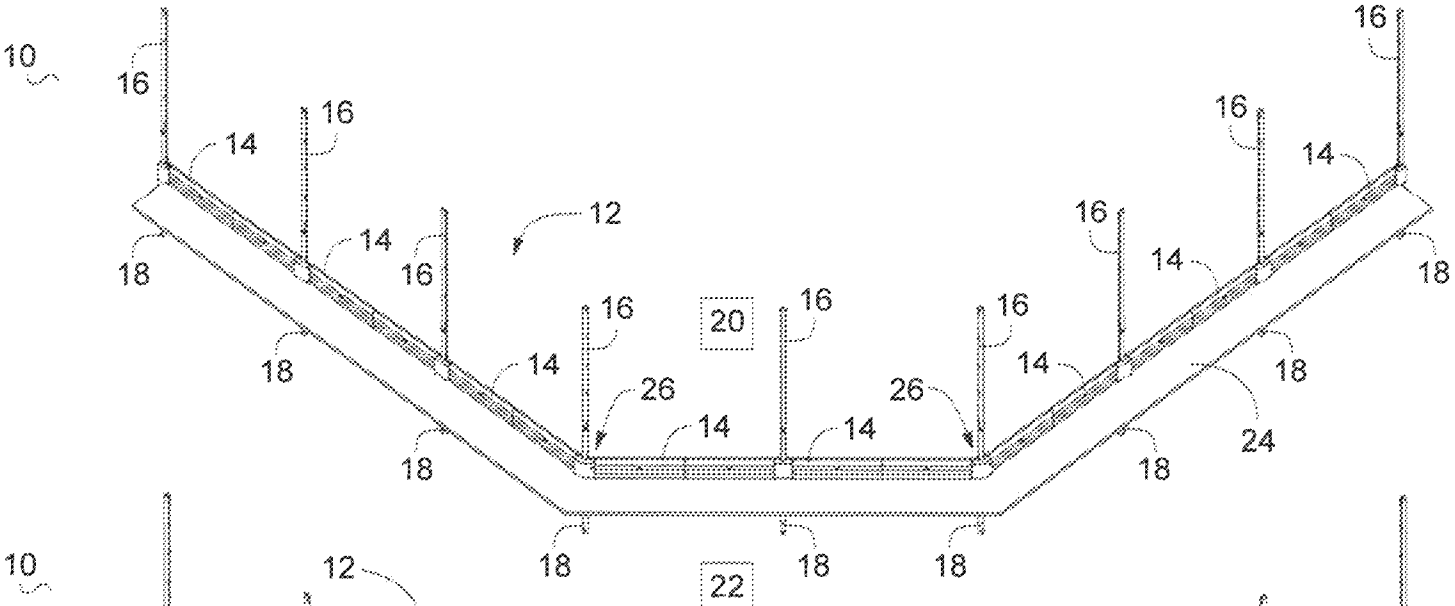
FIG. 1A is a perspective view of a backstop and netting system with a concrete walkway disposed on the spectator side of the backstop as viewed from the spectator side of the system, according to one embodiment.

The various embodiments herein relate to backstop and netting systems for use on various types of playing fields, including softball and baseball fields. Certain implementations are modular systems having coupleable wall sections and poles along with retractable netting such that the systems allow for easy installation and modification.

One exemplary embodiment of a combination backstop and netting system 10 is depicted in FIGS. 1A-E. As shown, the system 10 has a backstop 12 made up of multiple modular wall units 14 with multiple poles 16 attached thereto via multiple sleeves 18. In the specific system 10 depicted, the backstop 12 has eight wall units 14 with nine poles 16 and nine corresponding sleeves 18. Alternatively, depending on the desired size, the backstop 12 can have any number of wall units 14, poles 16, and sleeves 18. In various implementations, including the system 10 as shown, the system 10 is installed adjacent to a softball or baseball field 20 such that backstop 12 has an angled configuration with the field 20 disposed on the concave side of the backstop 12 and the viewing or spectator area 22 disposed on the opposite (or convex) side. Alternatively, due to the modular nature of the system 10 and depending on the type of sports field, the backstop 12 can have any configuration, including a straight (non-angled) configuration.

Figure 1B:
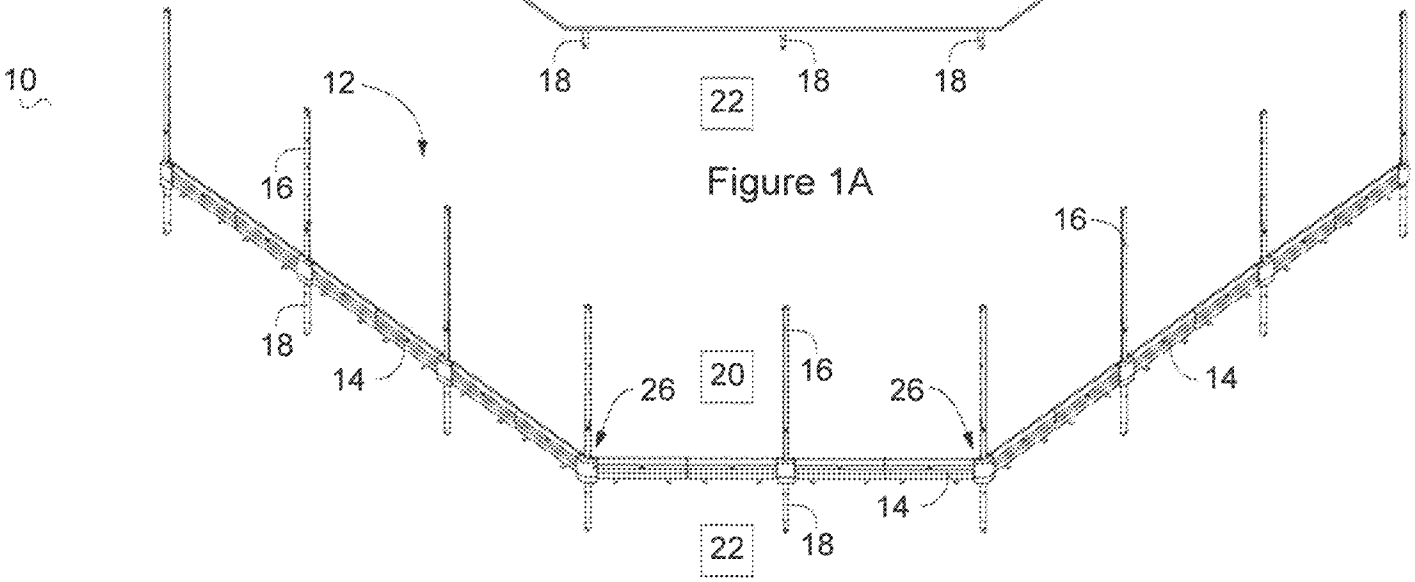
FIG. 1B is a perspective view of the backstop and netting system of FIG. 1 without a concrete walkway depicted, as viewed from the spectator side of the system, according to one embodiment.
Figure 1C:
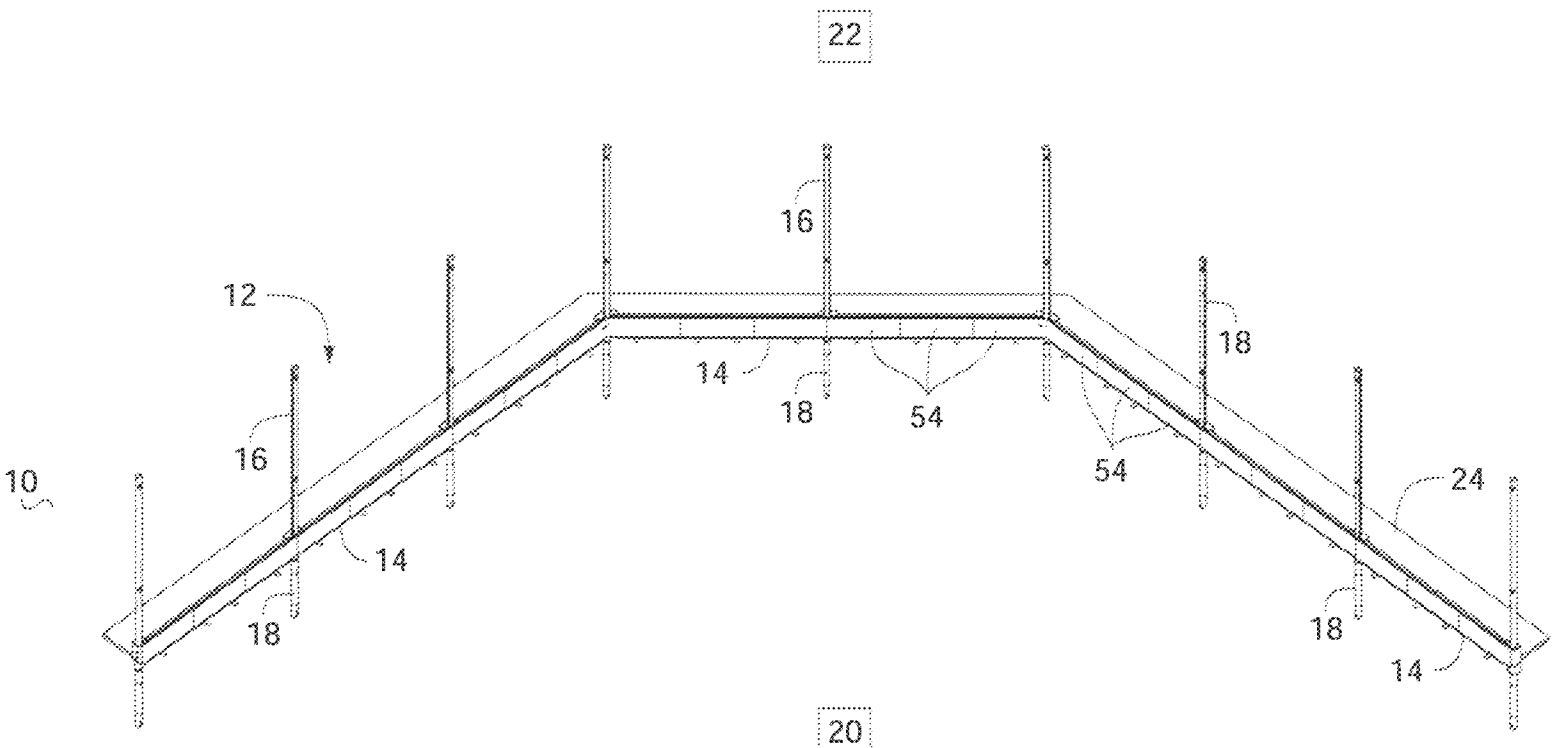
FIG. 1C is a perspective view of the backstop of netting system of FIG. 1 as viewed from the field side of the system, according to one embodiment.
Figure 1D:
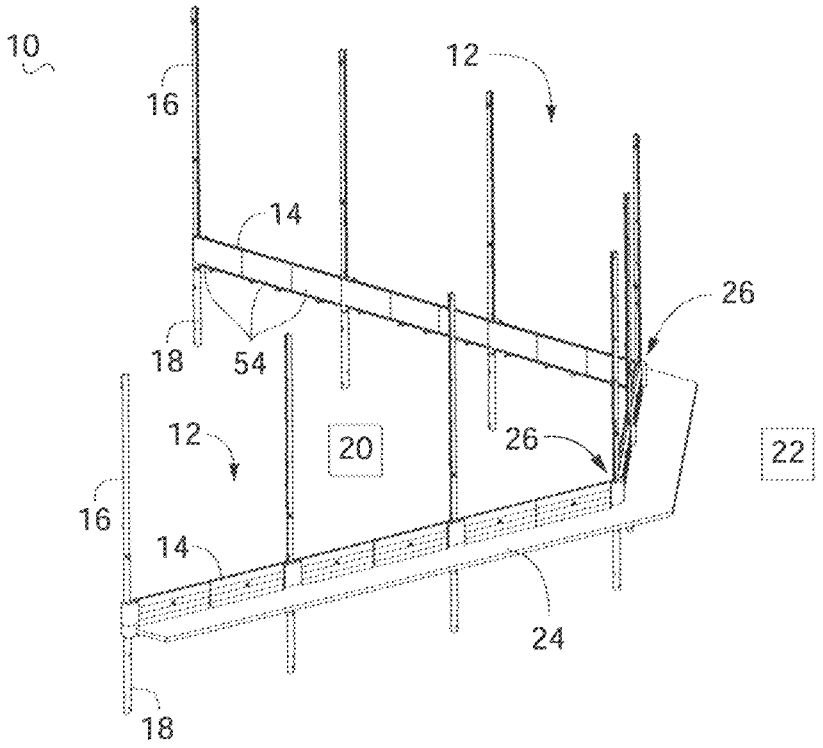
FIG. 1D is a perspective side view of the backstop and netting system of FIG. 1, according to one embodiment.

In accordance with certain aspects, as best shown in FIGS. 1A, 1C, and 1D, a concrete pad 24 can be added to the spectator side of the backstop 12. The concrete pad 24 can help to secure and stabilize the backstop 12 to the site while also providing a sidewalk for spectators along the spectator side of the backstop 12. That is, as discussed in further detail below, the spectator side of the backstop can serve as the concrete form on that side of the concrete when it is poured. FIG. 1B depicts the backstop 12 prior to the addition of the pad 24. Alternatively, no concrete pad is added.

Figure 1E:
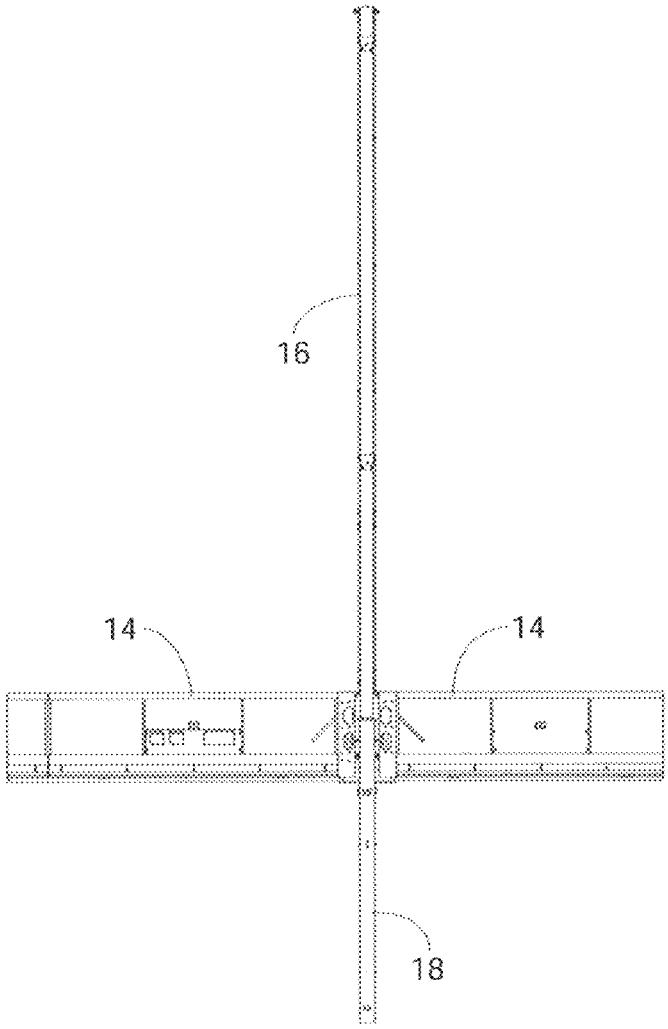
FIG. 1E is a side view of a pole and coupling sleeve of a backstop and netting system with two wall sections coupled thereto, according to one embodiment.

As best shown in FIG. 1E (and as will be described in additional detail below), each sleeve 18 provides both stability for the backstop 12 and coupling of the main components therein. More specifically, each sleeve 18 is positioned into the ground, is coupled to the ends of adjacent wall sections 14, and receives a poll 16 within the sleeve 18.

Figure 2A:
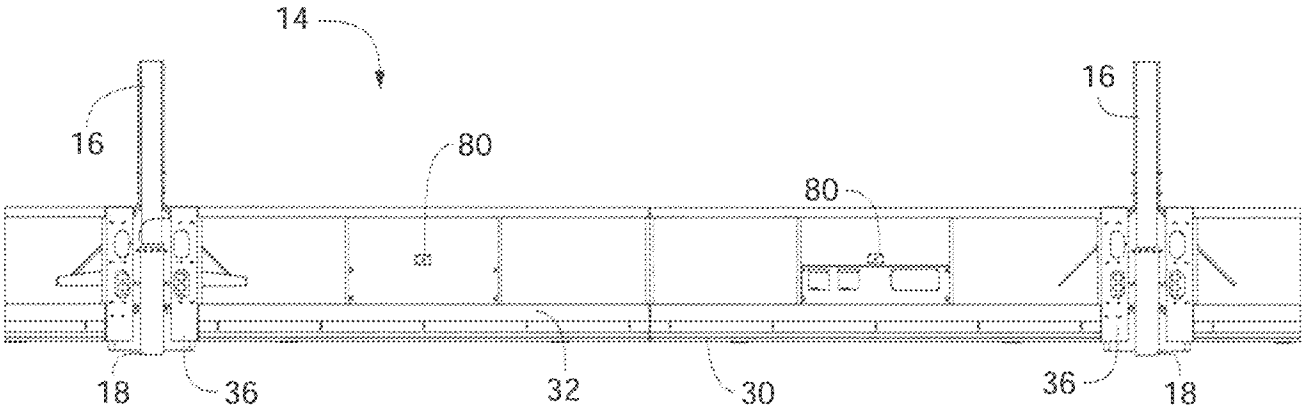
FIG. 2A is a side view of a wall section as viewed from the field side, according to one embodiment.
Figure 2B:
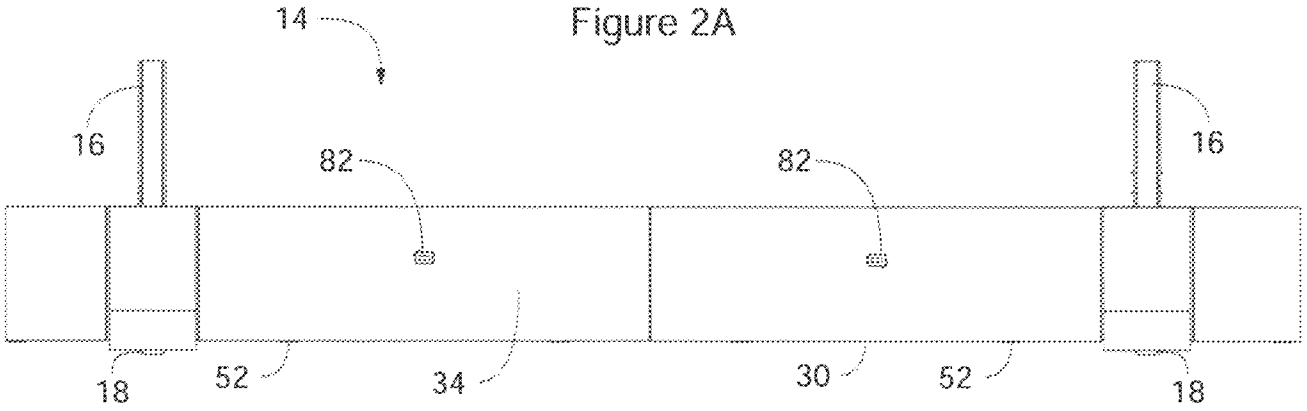
FIG. 2B is a side view of the wall section of FIG. 2A as viewed from the spectator side, according to one embodiment.
Figure 2C:
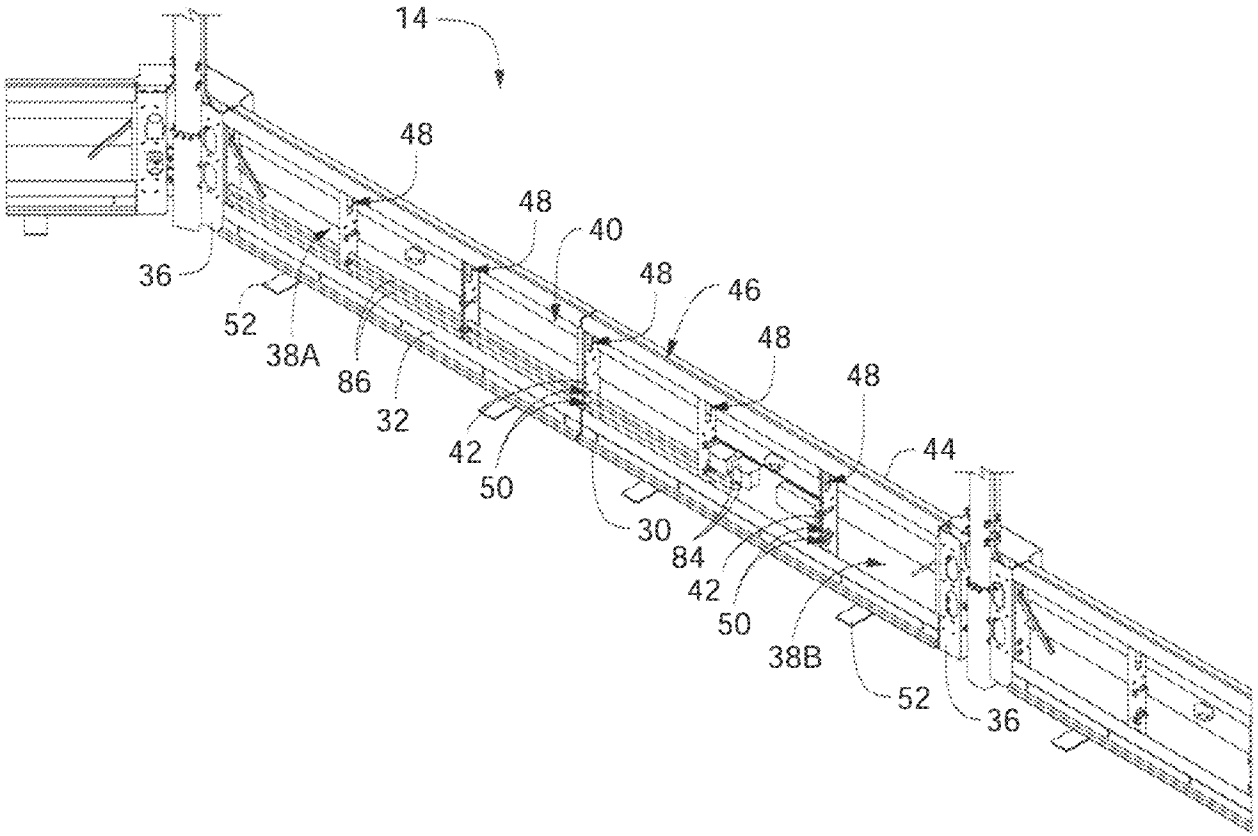
FIG. 2C is a prespective view of the wall section of FIG. 2A as viewed from the field side, according to one embodiment.

An exemplary wall section 14 is depicted in FIGS. 2A-2C, according to one embodiment. The wall is made up of an elongate wall body 30 having a first (or interior) side 32, a second (or exterior) side 34, and an end section (or "column") 36 disposed at each end of the body 30. As shown in FIG. 2C, the interior side 32 has two large openings 38A, 38B defined in the side 32 that provide access to the inner cavity 40 defined between the two sides 32, 34. Further, the wall body 30 also has vertical supports 42 disposed within the cavity 40 and a top opening (or top slot) 46 defined in the top surface 44 of the body 30. As will be described in further detail below, the slot 46 can be used to receive the netting 120 when it is retracted into the cavity 40 of the wall body 30. Further, as also shown in FIG. 2C, each of the vertical supports 42 has a vertical slot 48 defined therein that can receive the netting 120 when it is disposed in the cavity 40, along with at least one opening 50 defined therein, each of which can receive a conduit (such as conduits 86), electrical cords, or the like as described in additional detail below. In addition, each wall section 14 has two support structures (or "feet") 52 attached to a bottom portion of the section 14. The two feet 52 are positioned near opposite ends of the wall section 14 such that the feet 52 can be used to ensure that the wall section 14 can be positioned in an upright position during the installation process as described in further detail below.

Figure 4A:
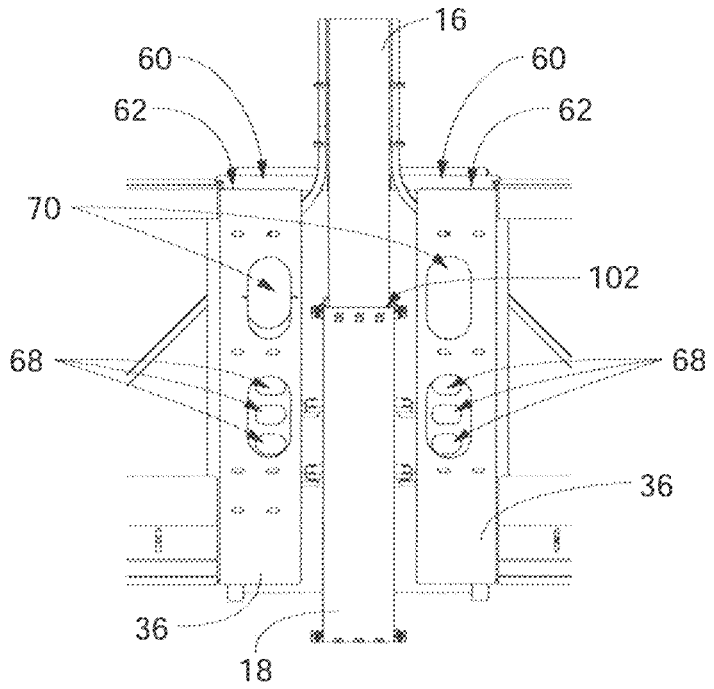
FIG. 4A is a side view of a junction of two wall sections with a sleeve and a pole, according to one embodiment.
Figure 4B:
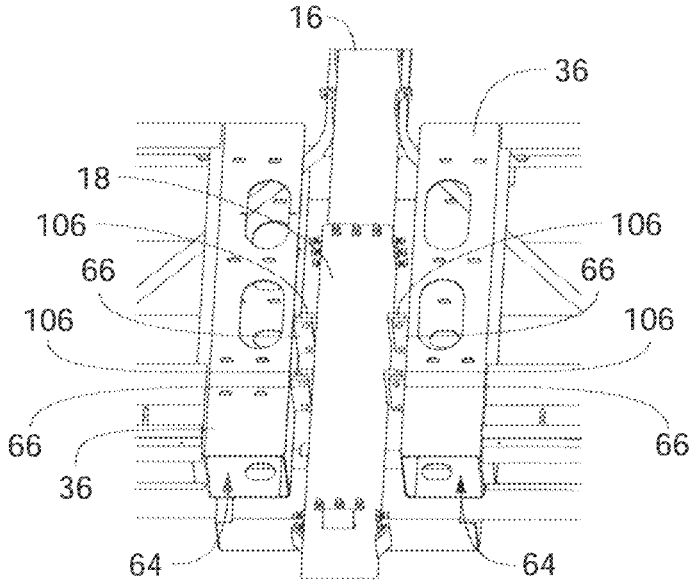
FIG. 4B is an expanded perspective view of the junction of FIG. 4A, according to one embodiment.

As best shown in FIGS. 2C, 4A, and 4B, the end columns 36 are attached at or integral with each end of the wall body 30. Each has a vertical shaft 60 defined through the column 36 with openings 62, 64 at the top and bottom of the column 36, respectively. In certain embodiments, each column 36 has one or more attachment structures 66 that allow for attachment of that column 36 (and thus that end of the wall body 30) to an attachment sleeve 18 (and thereby to a pole 16), as will be discussed in additional detail below, e.g. via one or more removable pins (not shown). In the specific implementation as shown in FIG. 4B, the attachment structures 66 are cylindrical pin-receiving structures 66 that extend from the column 36 as shown and mate or align with similar cylindrical pin-receiving structures 106 that extend from the sleeve 18. Alternatively, any known attachment structure or feature that can be used to attach the end of the wall body 30 to the sleeve 18 can be used.

Figure 4C:
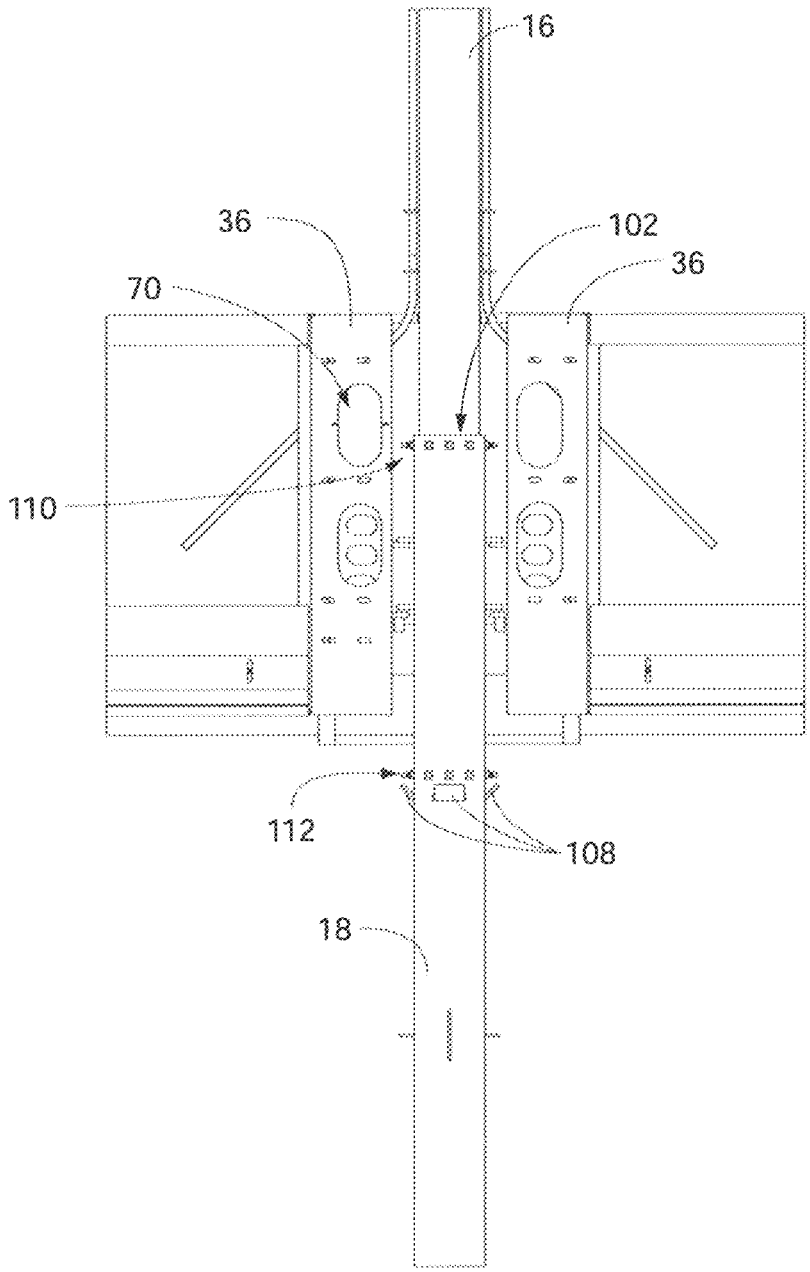
FIG. 4C is another side view of the junction of FIG. 4A, according to one embodiment.

In some embodiments as best shown in FIG. 4A, each end column 36 can have one or more conduit openings 68 defined in the exterior side of the column 36. According to certain implementations, the openings 68 are positioned to allow one or more flexible conduits (or other elongate components as discussed elsewhere herein) to pass through the openings 68 such that they can extend out of one end column 36 via an opening 68, around the pole 16, and back into the end column 36 on the other side of the pole 16 via an opening 68. Thus, any number of flexible conduits (as discussed elsewhere herein) can extend around the entire length of a backstop 12 by extending out of each wall section 14 on the spectator side and into the adjacent wall section 14 via the openings 68. In the specific exemplary column 36 as shown, there are five conduit openings 68. Alternatively, the column 36 can have one, two, three, four, six, or any other number of openings 68. In a further alternative, the column 36 can have no such openings. In addition, certain implementations of the end column 36 can include a ball return opening 70 defined in both the interior and exterior sides of the column 36, as best shown in FIGS. 4A and 4C. This allows patrons or other persons to return a ball to the field of play (e.g., in the event of a foul ball traveling up and over the system 10 and landing on the spectator side of the backstop 12). In such embodiments, corresponding openings will be provided in any removable padding sections (such as sections 54 as discussed elsewhere herein) on the interior side of the backstop 12 and in the cover 160A, 160B (as discussed elsewhere herein) on the external side. Alternatively, no such opening is provided.

Figure 3A:
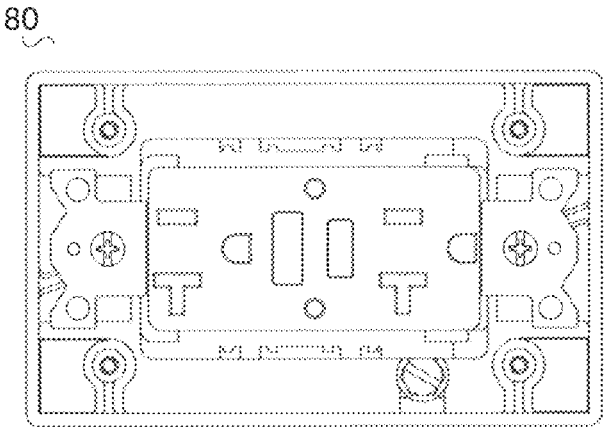
FIG. 3A is a side view of an electrical outlet that can be associated with a backstop and netting system, according to one embodiment.
Figure 3B:
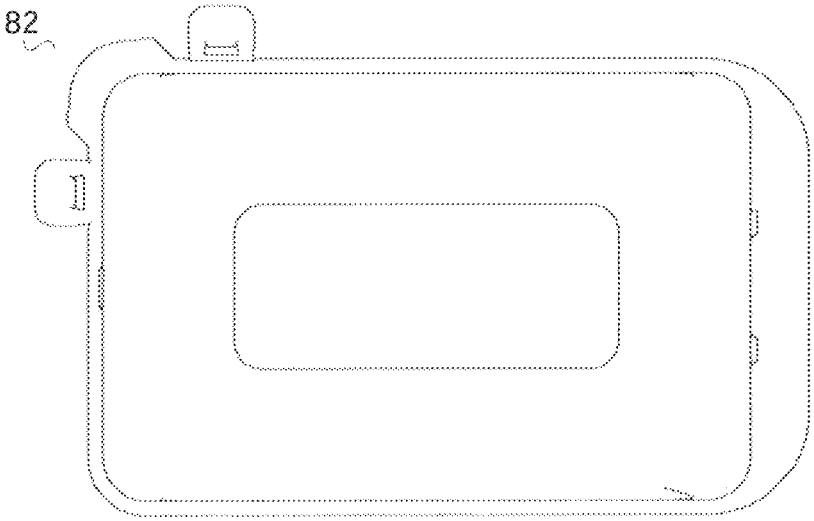
FIG. 3B is a side view of an outlet cover for the electrical outlet of FIG. 3A, according to one embodiment.

Returning to FIGS. 2A and 2B, certain implementations of the wall section 14 can include various additional components for use in enhancing the features of the system 10 and the playing field on which the system 10 is positioned. For example, the wall section 14 can have two electrical outlets 80 attached to the exterior side 34 of the wall body 30 (e.g., for patrons to access for charging their personal devices or the like). One exemplary embodiment of the outlet 80 is further depicted in FIGS. 3A and 3B. The outlet 80 can be disposed in the exterior side 34 such that the front of the outlet 80 faces the spectator side as shown in FIG. 2B, with the back of the outlet 80 extending into the cavity 40 as shown in FIG. 2A. Each outlet 80 can have a removable outlet cover 82, as shown in FIGS. 2B and 3B. Alternatively, the wall section 14 can have one outlet, three outlets, or any number of outlets.

In addition, as best shown in FIGS. 2A and 2C, the cavity 40 can also contain junction boxes 84 and conduits 86 attached to the junction boxes 84 such that any electrical cords attached to the junction boxes 84 can extend through the conduits 86. The junction boxes 84 can be available for providing power to any number of various accessories or optional components attached to or otherwise associated with the wall section 14. As discussed above, the conduits 86 can be positioned through openings 50 in the vertical supports 42 as shown. Alternatively, various insulated electrical cords and/or wiring can be disposed through the openings 50 and coupled to the appropriate box(es) 84 without the need for the conduits 86. As shown, the wall 14 has two junction boxes 84. Alternatively, the wall 14 can have one, three, or any number of junction boxes 84, depending on the number of desired accessories or components to be coupled to such boxes 84.

The conduits 86 can be any known conduits, either flexible or rigid. For example, in one specific embodiment, the conduits 86 can be either medium-wall steel conduit (rigid) or an oil-resistant liquid-tight flexible metal conduit (flexible) commercially available from McMaster-Carr in Elmhurst, IL. Further, the junction boxes 84 can be any known enclosures for electrical components. For example, in one specific embodiment, the junction boxes 84 can be the weather-resistant enclosures available from McMaster-Carr in Elmhurst, IL.

As mentioned above, and as best shown in FIG. 2C, the field side 32 of each wall section 14 can have two openings 38A, 38B that provide access to the cavity 40 therein, in accordance with certain embodiments. Alternatively, the field side 32 of the wall section 14 can have one opening, three openings, or any number of openings to allow access to the cavity 40. These embodiments can have padding sections 54 removable attached to the field side 32, as best shown in FIGS. 1C and 1D. In the exemplary embodiment as shown, there are three removable padding sections 54 attached to each wall section 14. Alternatively, the wall section 14 can have one, two, four, or any number of padding sections 54 removably attached thereto. According to some implementations, the spectator side 34 as best shown in FIG. 2B has no such openings or padding. Alternatively, the spectator side 34 of the wall 14 can also have one or more openings. In a further alternative, the spectator side 34 can have one or more removable padding sections that can only be removable from the field side or are otherwise attached in a fashion that prevents spectators from removing those sections. In a further embodiment, the spectator side 34 of the wall 14 can have a decorative façade or surfaces for indicia or advertisements.

The padding sections 54 can be any known sports field wall padding. For example, in one specific embodiment, the padding sections 54 can be tailored backstop padding commercially available from Fieldwallpads.com in Clarion, IA.

Figure 12:
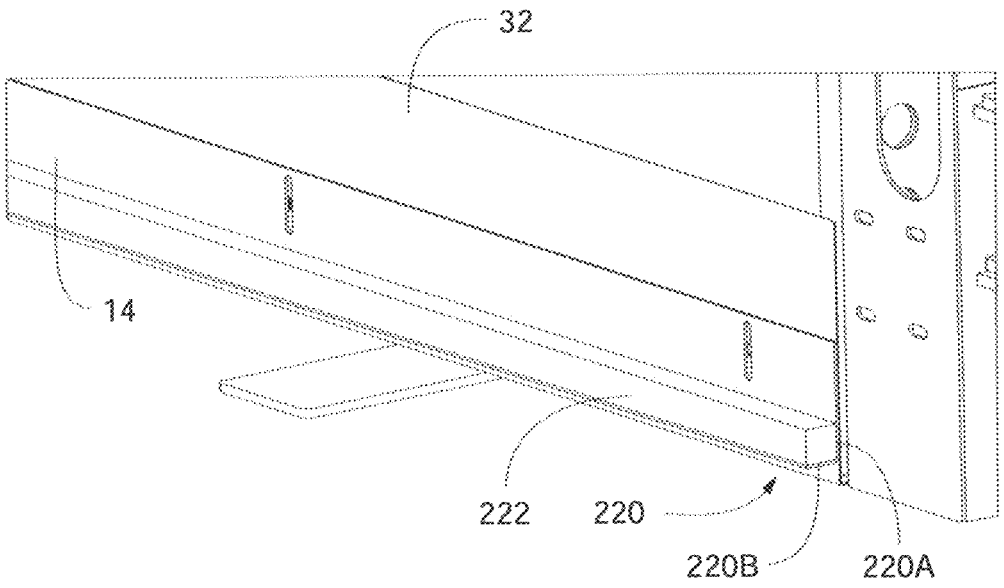
FIG. 12 is a perspective view of a portion of a wall section with a turf attachment structure, according to one embodiment.

As best shown in FIG. 12, in accordance with certain implementations, each wall section can also have an adjustable, removable turf attachment structure 220 attached to the field side 32 of the wall 14. The turf attachment structure 220 can be any structure that can be vertically adjustable on the wall section 14 and to which the field turf that is placed on the playing field can be attached. In the specific exemplary embodiment as shown, the turf attachment structure 220 is an L-shaped structure 220 with a vertical portion 220A that is adjustably and removably attached to the field side 32 of the wall 14 and a horizontal portion 220B extending away from the wall 14. In this exemplary implementation, a commercially available plastic "nailer" 222 is attached to the L-shaped structure 220 such that the turf can be attached to the structure 220 via the nailer. Alternatively, any adjustable, removable structure that can be used to allow turf to be attached to the wall section can be used.

The various wall section 14 embodiments disclosed or contemplated herein can have a length of about 24 feet and a height of three feet. Alternatively, the length of the wall 14 can range from about 12 feet to about 24 feet, depending on the desired overall size of the backstop 12. Further, the height of the wall 14 can range from about 2 feet to about 4 feet. The wall sections 14 can be made of commercial grade steel, aluminum, or some alloy thereof, for example. Further, the wall sections 14 can be formed using state-of-the-art machining, laser cutting, and/or forming techniques and processes, for example. If desired, parts can be galvanized (e.g., hot dipped), power coated, or further processed (e.g., for weather hardiness). Alternatively, the wall sections 14 can be made of any known material and via any known process for use in sports backstops and barriers.

Further, the various pole 16 implementations disclosed or contemplated herein can have a length of about 30 feet. Alternatively, the length of the pole 16 can range from about 20 feet to about 40 feet, depending on the desired overall size and height of the backstop 12. Further, each pole 16 can have a width of about 6 inches and a depth of about 6 inches. Alternatively, the pole 16 width and depth can vary by any known amounts as needed/desired. The poles 16 can be made of commercial grade steel, aluminum, carbon fiber, or some alloy thereof, for example. Further, the poles 16 can be formed using state-of-the-art machining, laser cutting, and/or forming techniques and processes, for example. If desired, parts can be galvanized (e.g., hot dipped), power coated, or further processed (e.g., for weather hardiness). Alternatively, the poles 16 can be made of any known material and via any known process for use in sports backstops and barriers.

As shown in FIGS. 4A and 4B, certain system 10 embodiments can also have an elongate attachment body (or "sleeve") 18 that couples two wall sections 14 to a pole 16. In some aspects, the sleeve 18 allows for some freedom of movement of the wall sections 14 in relation to the pole 16 to which it is attached, thereby providing some adjustability and ability to modify the positioning of the walls 14 and the poles 16 during installation (e.g., if site conditions are not as expected, the ground is not level, etc.).

As best shown in FIGS. 1E, 4A, and 4C, the sleeve 18 has an open shaft or elongate cavity (not shown) defined through the length of the sleeve 18 with an opening 102 at one end (the "top" end) of the sleeve 18 in communication with the shaft or cavity. As such, a pole 16 can be inserted through the opening 102 and into the shaft such that the pole 16 is positioned in the sleeve 18 and extends out of the opening 102. According to one embodiment, the elongate cavity (not shown) of the sleeve 18 that can receive a pole 16 extends from the top opening 102 to an internal structure 108 disposed within the cavity of the sleeve 18 that blocks any further progress of the pole 16 within the sleeve 18. In one specific embodiment, the internal structure 108 is made up of four angle irons 108 (three of which are visible in FIG. 4C) that extend from an external area into the cavity of the sleeve 18, thereby providing a contact point for the end of the pole 16 within the sleeve 18. Alternatively, the internal structure 108 can be any known structure, such as, for example, a lip, flange, or any other structure or object that is fixed in place within the sleeve 18 and prevents the pole 16 from extending any further within the sleeve 18.

In addition, the sleeve 18 can have two sets 110, 112 of set screws or other adjustable attachment devices that can be used to position and fix the pole 16 in place in relation to the sleeve 18. More specifically, as discussed in further detail below, each of the set screws 110, 112 can be separately adjusted to modify the positioning of the pole 16 to ensure that the pole 16, and thus the entire backstop 12, is level.

Further, as mentioned above, certain implementations of the sleeve 18 have one or more attachment structures 106 disposed on opposing sides of the sleeve 18 that allow for attachment of that sleeve 18 to a wall section 14. In the specific implementation as shown in FIG. 4B, the attachment structures 106 are cylindrical pin-receiving structures 106 that extend from the sleeve 18 as shown and mate or align with similar cylindrical pin-receiving structures 66 that extend from the wall sections 14 that are to be attached on each side of the sleeve 18. More specifically, there are four such pin-receiving structures 106 on each side of the sleeve 18 (for a total of eight), with two upper structures 106 and two lower structures 106. Alternatively, any known attachment structure or feature that can be used to attach the end of the wall body 30 to the sleeve 18 can be used.

Each sleeve 18 embodiment as disclosed or contemplated herein can have a length of about 2 feet. Alternatively, the length of the sleeve 18 can range from about 2 feet to about 12 feet. Further, the inner dimensions of the shaft defined by the sleeve 18 can have a width of about 7 inches and a depth of about 7 inches. Alternatively, the width and depth can range from about 4 inches to about 12 inches. In a further alternative, the inner dimensions can be any width and depth that allows for a pole 16 to be disposed therethrough. The various sleeve embodiments 18 herein can be made of the same materials and via the same processes as the wall sections 14 or poles 16 as discussed above.

According to some embodiments, the sleeve 18 provides some freedom of movement among the coupled wall sections 14 and pole 16. More specifically, the attachment structures 106 have some limited freedom of movement in relation to the wall sections 14 to which they are attached such that some adjustability is possible. Further, the set screws 110, 112 also allow for some adjustability, in this case for the pole 16 in relation to the sleeve 18. As such, there is some freedom of movement of the various components during assembly of the backstop 12, thereby ensuring some amount of adjustability such that the various components are disposed and attached in relation to each other in a way that optimizes the positioning and stability of the entire backstop 12.

Figure 5A:
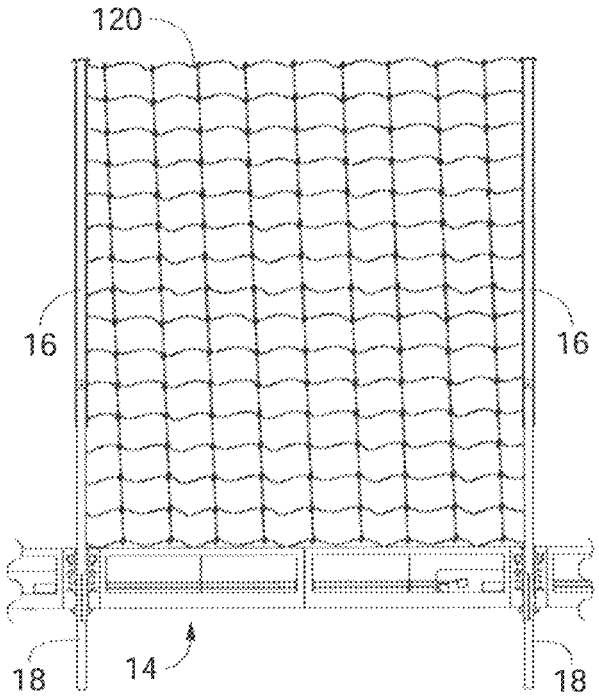
FIG. 5A is a side view of one wall section with the netting in the deployed position, according to one embodiment.
Figure 5B:
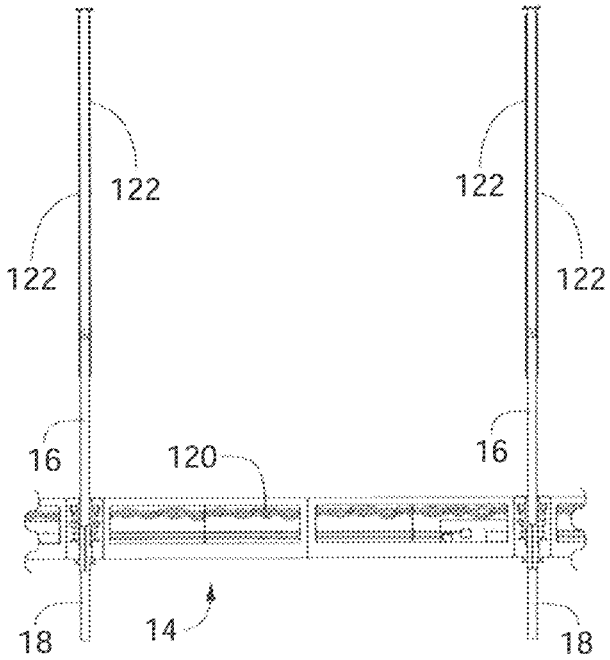
FIG. 5B is a side view of the wall section of FIG. 5A with the netting in the retracted position, according to one embodiment.

As shown in FIGS. 5A and 5B, the various system 10 implementations herein include deployable and retractable netting sections 120 that are sized to fit between and attach to the poles 16 attached to opposite ends of the corresponding wall section 14. In other words, the netting sections 120 are also modular in the same fashion as the rest of the components of the system 10. As such, each section 120 has a width that is substantially similar to the length of the corresponding wall section 14 such that the netting section 120 extends between and is attachable to the opposing poles 16. Further, the various netting section 120 embodiments herein are movable between a deployed position as shown in FIG. 5A and a retracted position as shown in FIG. 5B in which the netting section 120 is disposed within wall section 14 as described above.

According to some aspects, the netting 120 can be any known netting for use in conjunction with baseball or softball backstops. For example, the netting 120 can be the Ultra Cross® Knotless Netting, which is commercially available from Sportsfield Specialties, Inc. in Delhi, NY.

Figure 6A:
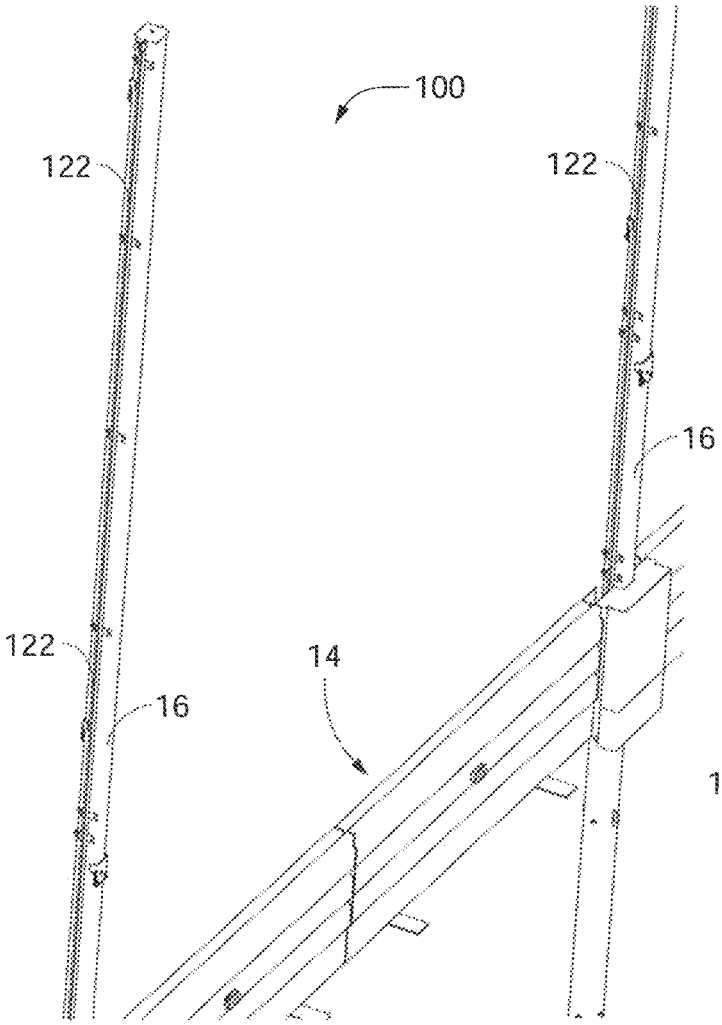
FIG. 6A is a perspective view of two poles coupled to a wall section, according to one embodiment.
Figure 6B:
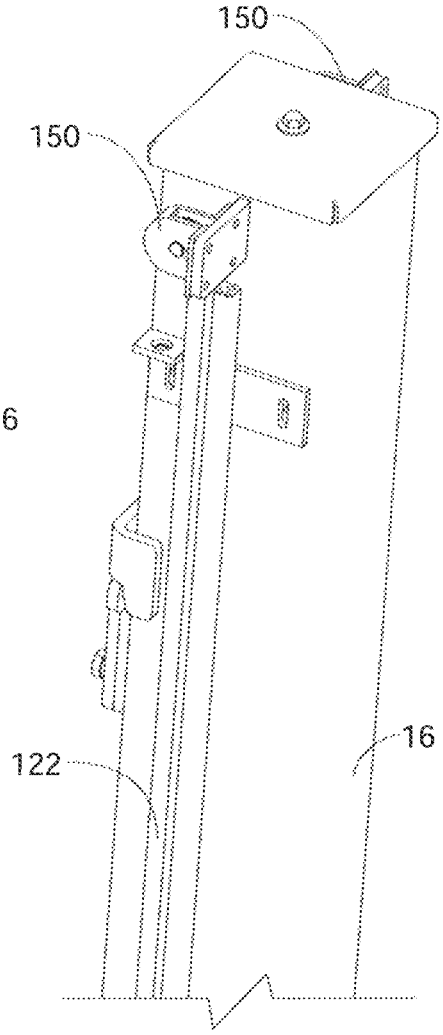
FIG. 6B is an expanded perspective view of a top portion of one pole, according to one embodiment.
Figure 7A:
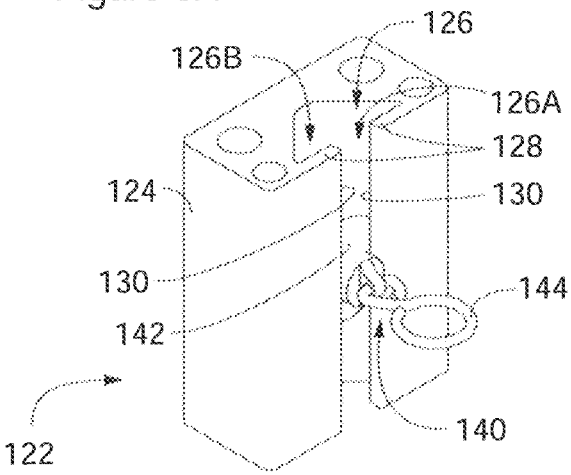
FIG. 7A is a perspective view of an attachment track and attachment device, according to one embodiment.

In one embodiment as best shown in FIGS. 5A-7, the netting 120 is moveably attached to each pole 16 via an attachment track 122 on the pole 16. More specifically, each pole 16 has two attachment tracks 122, one on each side of the pole 16 facing the adjacent pole 16. Alternatively, in certain embodiments, the poles 16 intended to be disposed at each end of the backstop 12 can have an attachment track 122 on only one side of the pole 16. According to one implementation as best shown in FIGS. 6B and 7, the track 122 is made up of an elongate track body 124 with a channel 126 defined within the track body 124. The channel 126 has a narrow portion 126A defined by the lips 130 of the outer surface 128 of the track body 124 and a wider portion 126B defined within the body 124 that helps to form the lips 130 on either side of the narrow channel 126A, as best shown in FIG. 7A.

Continuing with FIG. 7A, slidably attached to this track 122 embodiment is a slidable attachment device 140 that can be coupled to a portion of the netting 120 and thereby couple the netting 120 to the track 122. More specifically, in one implementation, the slidable attachment device 140 has a slidable body 142 to which an attachment loop 144 is attached. The slidable body 142 is sized to fit within the wider portion 126B of the channel 126 but has a diameter that is greater than the width of narrow channel 126A. As such, the slidable attachment device 140 is attached to the track 122 such that the slidable body 142 is slidable disposed within the wide channel 126B and the attachment loop 144 extends outward through the narrow channel 126A so that the netting 120 can be attached to the loop 144. The slidable body 142 can slide within the wide channel 126B but is too large to be removed from the channel 126 through the narrow channel 126A.

Figure 7B:
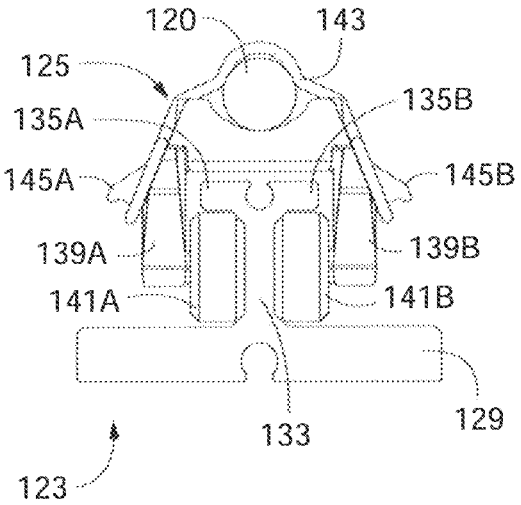
FIG. 7B is a cross-sectional top view of an attachment track and attachment device, according to one embodiment.
Figure 7C:
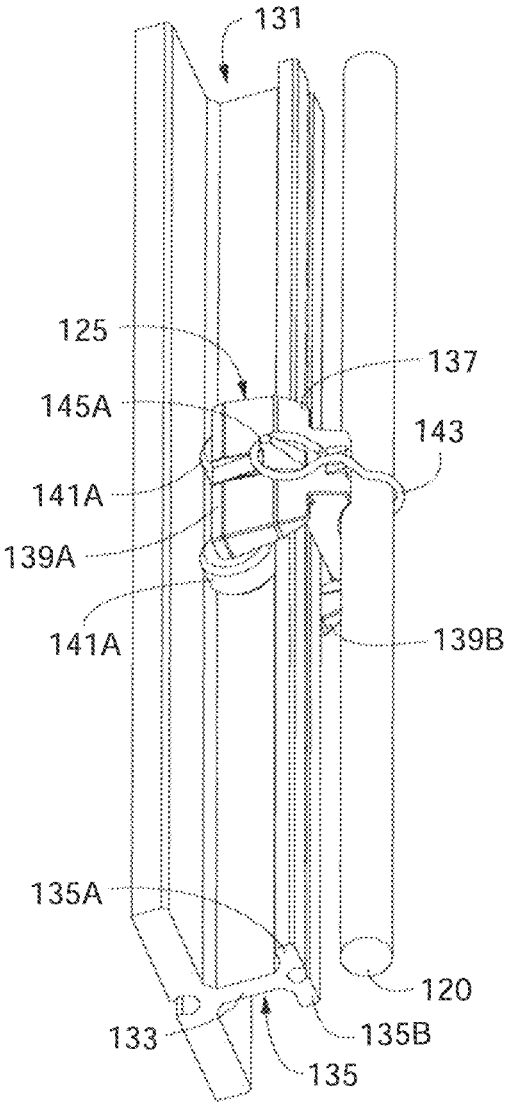
FIG. 7C is a perspective view of an attachment track and attachment device in use, according to one embodiment.

Alternatively, FIGS. 7B and 7C depict a different embodiment of a track 123 and a corresponding slidable attachment device 125. More specifically, the track 123 has a base 129 that is attachable to a pole 16. Extending from the base 129 is a T-shaped rail 131 having a rail body 133 and a crossbeam 135 attached to the rail body 133 such that the crossbeam 135 forms lips or protrusions 135A, 135B on each side of the crossbeam 135.

Slidably attached to the track 123 is a slidable attachment device 125 that includes a device body 137 that can be a C-shaped body 137 as shown. More specifically, the body 137 has two arms 139A, 139B with two track wheel pairs 141A, 141B attached to the inner wall of each of the arms 139A, 139B as best shown in FIG. 7B. Further, the device 125 has an attachment loop 143 that is coupled at each end to the body 137 via protrusions (or hooks) 145A, 145B extending from the body 137 such that a portion 120 of the netting can be attached via the loop 143 as shown. The device 125 can be attached to the track 123 with the wheels 141A disposed on one side of the rail 131 (and retained in place by the lip 135A) and the wheels 141B disposed on the other side of the rail 131 (and retained in place by the lip 135B) such that the slidable attachment device 125 can slide (or roll) along the rail 131 with the wheels 141A in contact with and rollable along the lip 135A and the wheels 141B in contact with and rollable along the lip 135B.

There are at least two slidable attachment devices (such as device 140 or device 125) slidably attached to each corresponding track 122, 123 and to the netting 120 attached thereto, thereby ensuring that the netting 120 is attached to the pole 16 along the length thereof. In some implementations, there is one attachment device 140, 125 provided for each each foot of track 122, 123 (resulting in roughly 27 attachment devices 140, 125 for a 30 foot pole 16). Alternatively, any number of devices 140, 125 per any length of pole 16 can be used such that any number of devices 140, 125 from two to 40 or any other number of attachment devices 140, 125 are used to slidably attach the one side of the netting 120 to the pole 16.

In accordance with certain aspects, each attachment loop 143, 144 is a breakaway loop 143, 144 that is structurally designed to fail (either break or deform) when a predetermined amount of force is applied to the loop 143, 144. In other words, each loop 143, 144 is designed to fail when sufficient external force is applied to the netting 120 such that the netting 120 pulls away from the loop 143, 144 and thereby avoids causing any damage to the netting 120 or the pole 16 to which it is/was attached. Thus, any inclement weather resulting in damaging forces being applied to the netting 120 and poles 16—such as rain or high winds, for example—are prevented from damaging the netting or poles 16 by the breakaway nature of the loops 143, 144. Each loop 143, 144 can be made of stainless steel wire, as is commercially available and formed using state-of-the-art techniques and processes.

Alternatively, the attachment tracks 122, 123 and corresponding attachment devices 140, 125 can be any known attachment devices or components that allow for slidably attaching the netting 120 to the poles 16. Further, the various attachment track 122, 123 and attachment device 140, 125 embodiments herein can be made of the same materials and via the same processes as the wall sections 14 as discussed above, or as another example, could be extruded.

For example, in one implementation, the attachment track 122 can be the t-slotted framing commercially available from McMaster-Carr in Elmhurst, IL.

As best shown in FIG. 6B, each pole 16 can also have a pulley 150 associated with each attachment track 122, 123 such that the pulley 150 can be used to raise and lower the netting 120 attached thereto. The pulley 150 can be any known pulley 150 for use with such sports equipment. For example, in one specific embodiment, the pulley 150 can be a mounted pulley commercially available from McMaster-Carr in Elmhurst, IL. The netting 120 can have ropes (not shown) attached on each side thereof, each of which can be threaded through the pulley 150 such that the ropes can be used to raise or lower the netting 120. In one specific implementation, the ropes can be the wet-environment rope commercially available from McMaster-Carr in Elmhurst, IL.

Figure 8A:
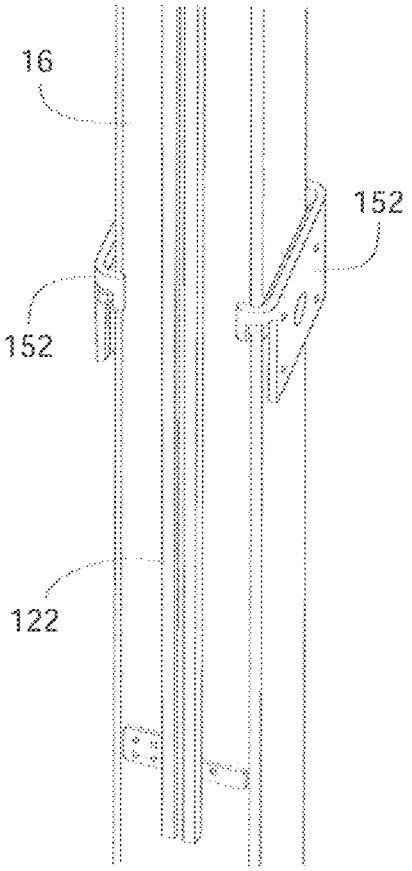
FIG. 8A is a perspective view of a portion of a pole, according to one embodiment.
Figure 8B:
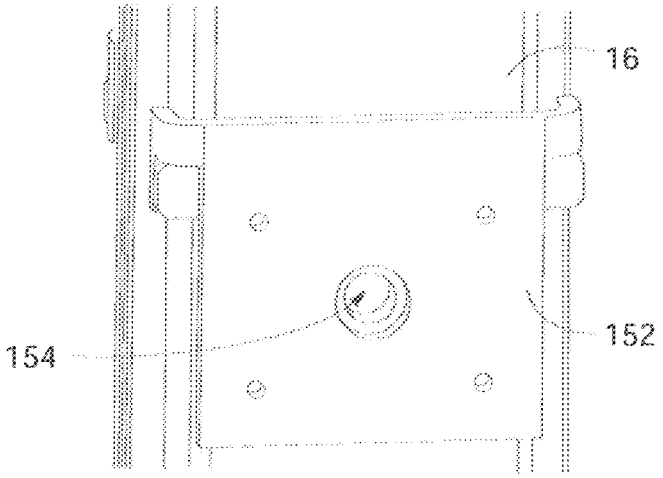
FIG. 8B is a perspective view of a portion of a pole with a bracket, according to one embodiment.

In addition, in some aspects as best shown in FIGS. 8A and 8B, each pole 16 can have at least one attachment bracket 152 attached on two opposing sides of the pole 16. More specifically, the brackets 152 are attached on the sides facing the field and the spectators as shown (the sides that do NOT have attachment tracks 122). Each bracket 152 has a through-hole 154 formed in the bracket 152 through which any electrical wires or other such items can be disposed as needed. Each bracket 152 can be used to attach any accessories or optional devices or objects on either or both sides of each pole 16 as desired or needed for the system 10. For example, the types of objects that may be hung on any one or more of the brackets 152 can include, but are not limited to, cameras, speakers, a radar gun, TV monitors, ball/strike visual indicators, outlets, phone charging stations, ribbon boards, pathway egress lighting, and/or emergency lighting or signage.

Figure 13:
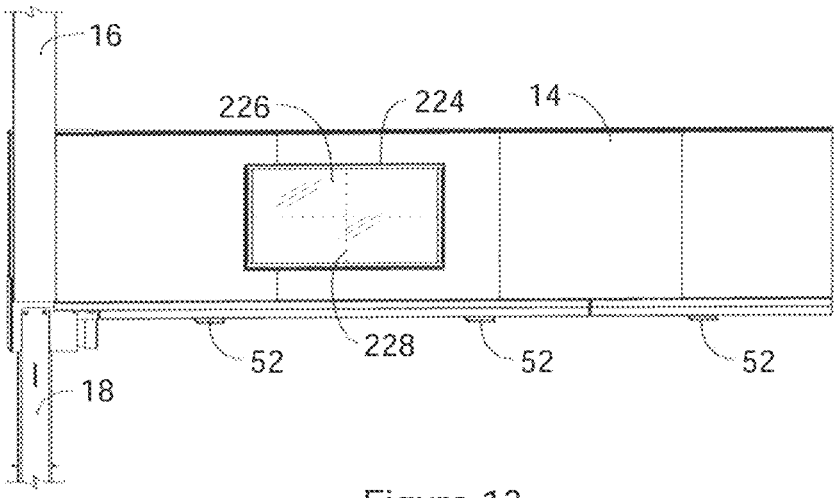
FIG. 13 is a front view of a portion of a wall section with a video board, according to one embodiment.
Figure 14:
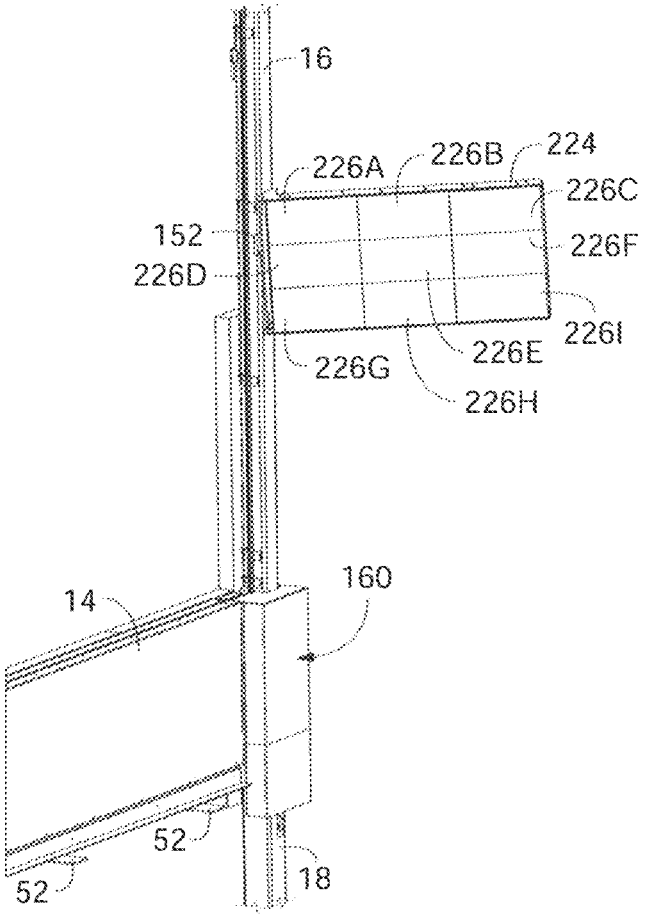
FIG. 14 is a perspective view of a pole including a video board, according to one embodiment.
Figure 15:
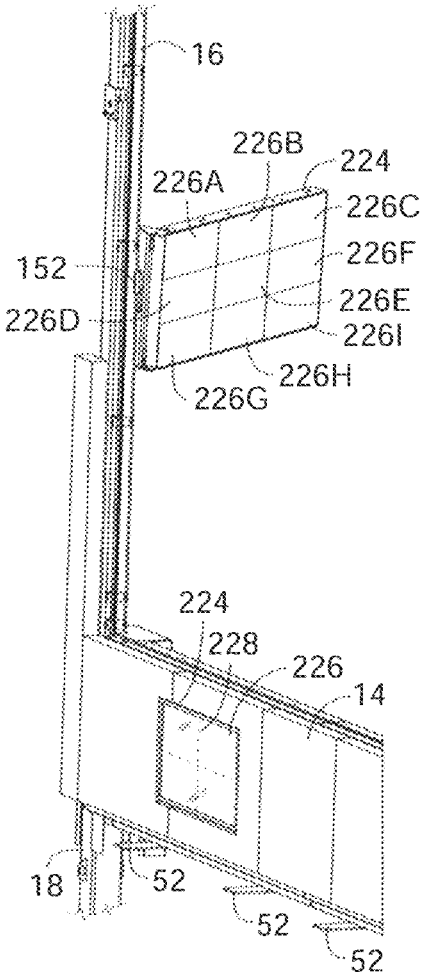
FIG. 15 is a perspective view of a wall section including a video board and a pole including a video board, according to one embodiment.

In one specific set of examples as shown in FIGS. 13-15, TVs or video boards 224 can be attached in various configurations on the backstop 12 using such brackets 152 (or alternatively using any known attachment devices similar to the brackets 152). The video boards 224 can be mounted either in the spectator poles 16 (as shown in FIG. 14, according to one exemplary embodiment), in the walls 14 (as shown in FIG. 13 according to another exemplary embodiment), or at both locations (as shown in FIG. 15 according to a further exemplary embodiment). According to certain embodiments, the video boards 224 can be mounted at various locations along the length of the entire backstop 12. For example, in those embodiments in which the backstop 12 is used for a baseball or softball field, video boards 224 can be mounted both the first base side and the third base side.

The video boards 224 embedded into the walls as shown in FIGS. 13 and 15 can include many different features. For example, to prevent damage, the video boards 224 can be coated in a polycarbonate covering 228 or other damage-preventative covering. This covering 228 can be an additional layer or sheet of material placed over the video board 224. The polycarbonate covering 228 is a clear or transparent material that provides visual access to the video board 224. The covering 228 can have the same or similar dimensions as the video board 224 and can have a thickness of approximately 0.5 inches. A polycarbonate layer or covering 228 protects the video board 224 from any projectiles that may otherwise damage it. Alternatively, any other known protective or additional features can be incorporated into the video boards 224.

In accordance with various implementations, the video boards 224 attached to the poles 16 can include many different features from those embedded into the walls 14. For example, one or more of these video boards 224 can include up to nine screen panels 226A-226F. A bracket 152 can be attached to the side of the video board 224 that is to be connected to the pole 16 during installation. Further, in some embodiments, a board 224 attached to a pole 16 may not have a polycarbonate covering because the board 224 is not subjected to the same risk of projectile damage as board disposed in a wall 14.

Figure 9A:
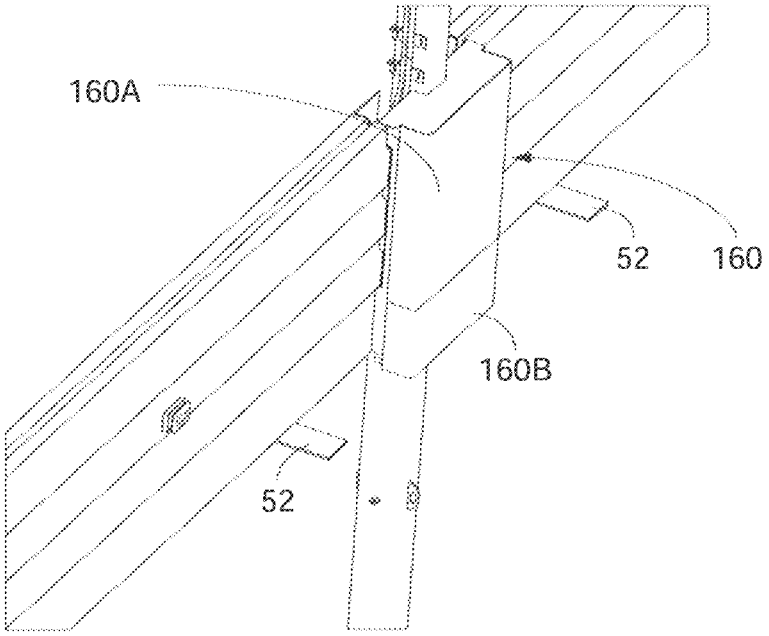
FIG. 9A is a perspective view of a junction with a covering disposed over the junction, according to one embodiment.
Figure 9B:
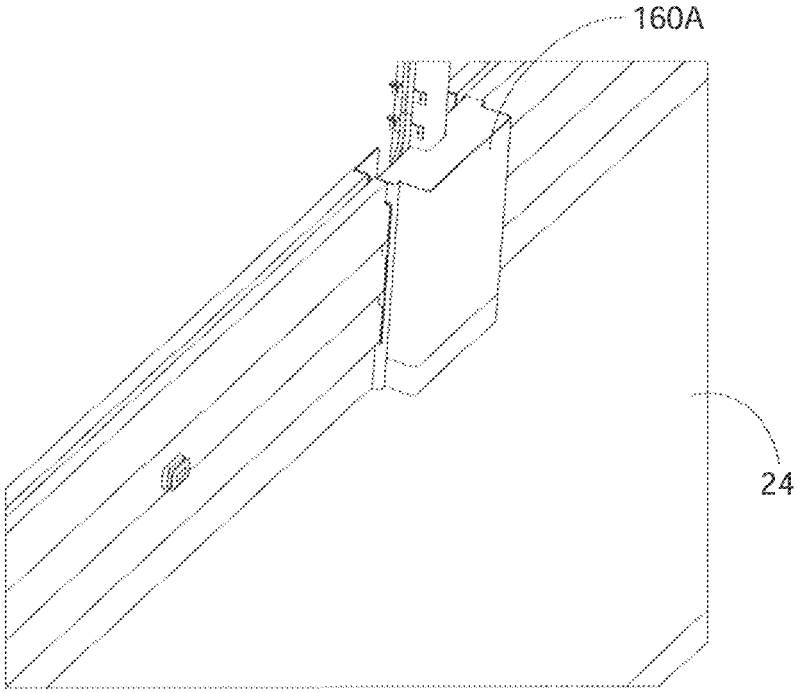
FIG. 9B is a perspective view of the junction and covering of FIG. 9A with a concrete walkway disposed adjacent to the junction and covering, according to one embodiment.
Figure 9C:
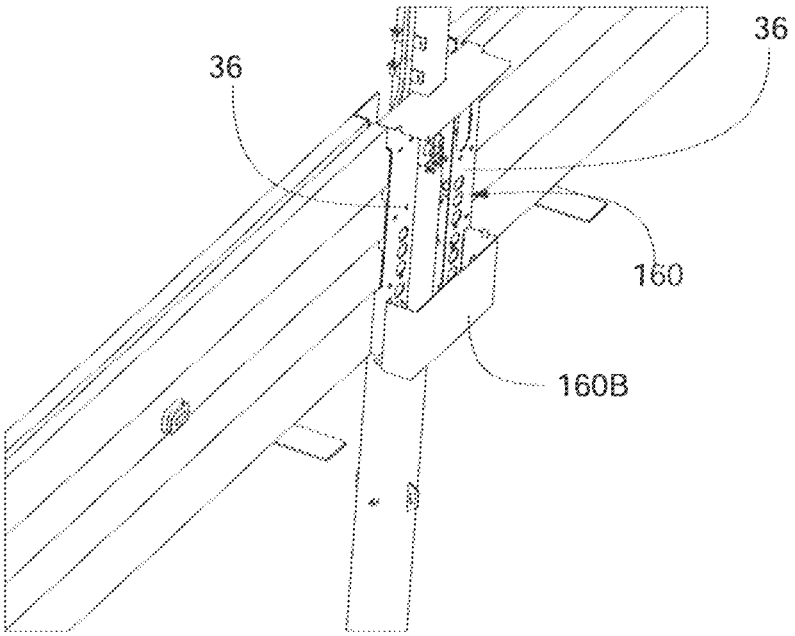
FIG. 9C is a perspective view of the junction and covering of FIG. 9A with a portion of the covering removed, according to one embodiment.

As shown in FIGS. 9A and 9B, aspects of the invention include covering conduit 86 and any other internal devices at junctions 160 with a two-part covering 160A, 160B such that when concrete pad 24 is installed, junctions 160 are secured against vandalism and add rigidity to the system 10. As can be seen by FIG. 9C, part 160B is bolted or otherwise affixed to a portion of end sections 36. Following this, part 160A can be lowered and snapped into abutment with part 160B (FIG. 9A), and then concrete pad 24 installed (FIG. 9B); here, poured directly up against part 160B and leveled. As a benefit, concrete pad 24—when installed—forms over or otherwise covers at least a portion of feet 52 which, again, adds rigidity to system 10. According to certain embodiments, the two-part covering 160A, 160B can be made of the same materials and via the same processes as the wall sections 14 as discussed above.

In certain embodiments as best shown in FIGS. 1A and ID, the backstop 12 can have two corners or angles formed at the junction of two wall sections 14 (corner junctions 26), thereby ensuring the backstop 12 conforms to the desired shape of the playing field (for purposes of baseball and softball fields, for example). Alternatively, depending the type of sport/field and/or the desired configuration of the system 10, there can be three, four, five, six, or any number of corner or angled junctions 26. In a further alternative, there can be no angles or corners.

Figure 11A:
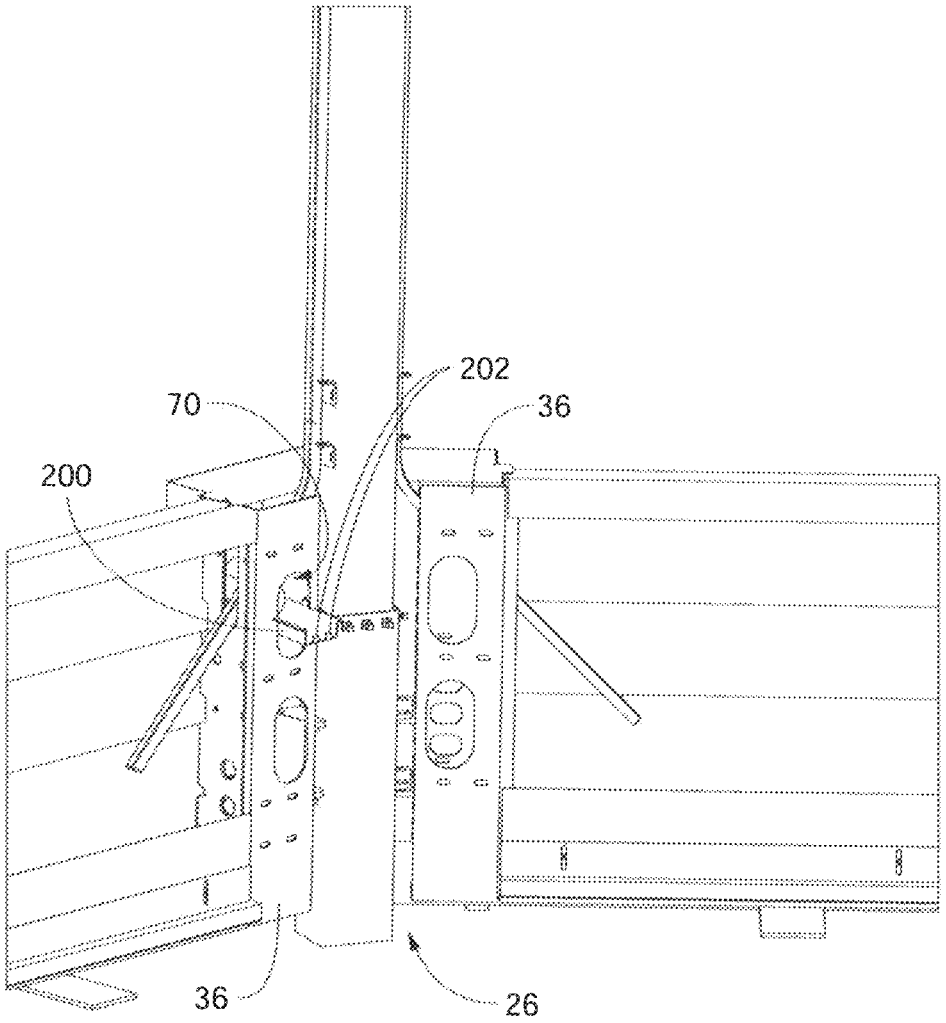
FIG. 11A is a perspective view of an angled junction viewed from the field side, according to one embodiment.

As best shown in FIGS. 11A-11D, the corner junctions 26 can have a different configuration in comparison to the non-angled junctions (as shown for example in FIGS. 4C and 9A-9C and discussed above). That is, as best shown in FIG. 11A, the interior side of the corner junction 26 can have a ball return opening 70 with a ball track 200 for retaining any ball inserted into the opening 70. In other words, if a spectator inserts a ball into the opening 70 from the spectator side as discussed above, the ball will pass through the opening 70 on the track 200. In certain embodiments, the track 200 is angled downward from the spectator side to the field side such that the ball will roll toward the end of the track 200 on the field side. In certain embodiments, the track 200 has a blocking structure 202 at the field end of the track 200 such that the ball must stop at that point on the track 200. In the specific implementation as shown, the blocking structure 202 is made up of two tabs 202 extending upward at the end of the track 200 to stop the progress of the ball on the track 200. Alternatively, any type of structure that can prevent the ball from rolling past the end of the track 200 can be used as the blocking structure 202.

Figure 11B:
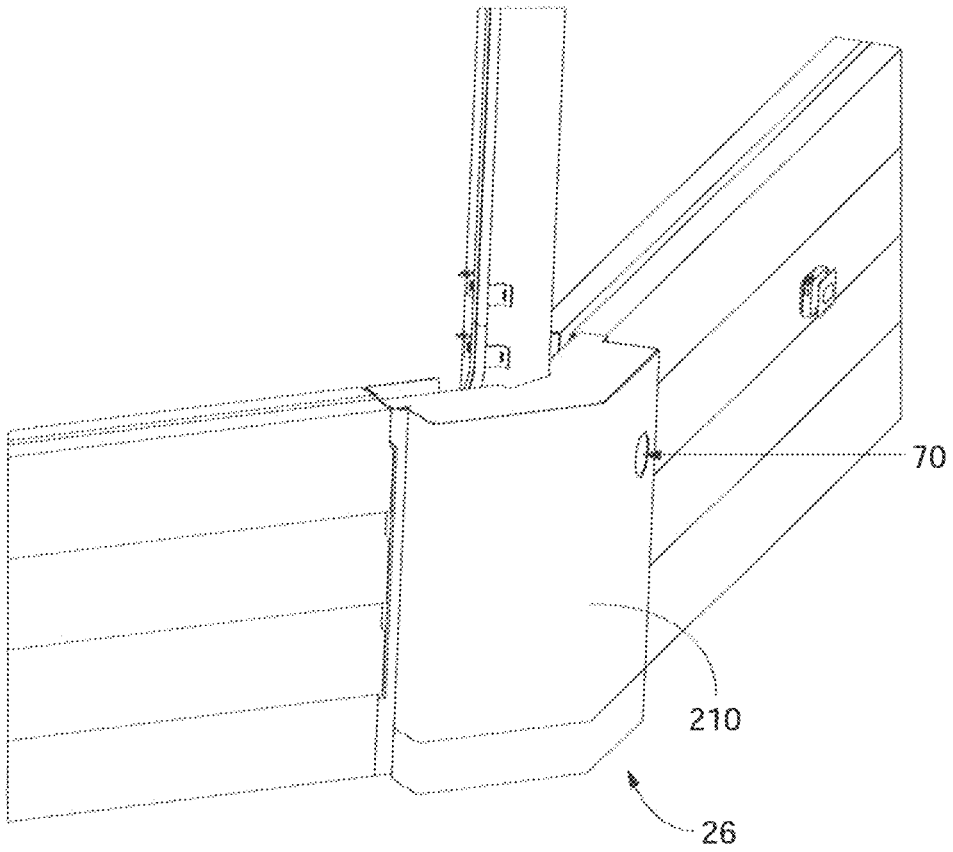
FIG. 11B is a perspective view of an angled junction with a junction cover viewed from the spectator side, according to one embodiment.
Figure 11C:
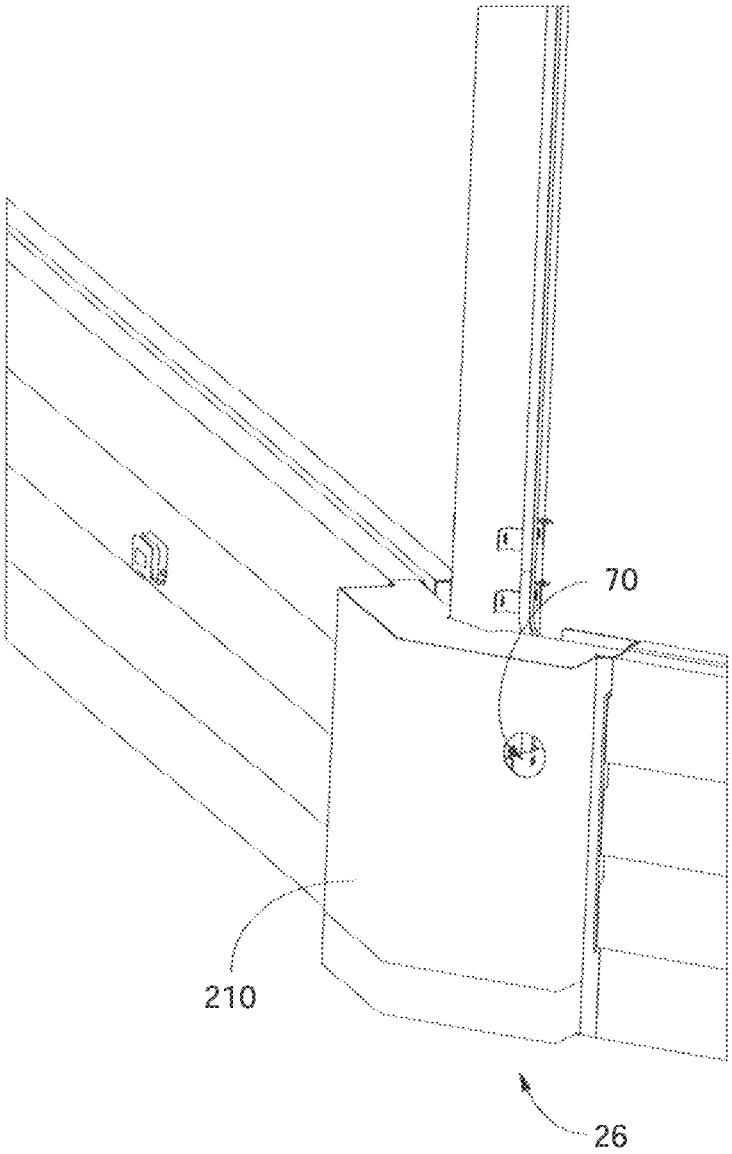
FIG. 11C is another perspective view of the angled junction of FIG. 11B, according to one embodiment.

Further, as shown in FIGS. 11B and 11C, the external or spectator side of the angled junction 26 can have an angled joint cover 210 that is attached to the external side of the junction 26. The junction cover 210 can be substantially similar to the coverings 160A, 160B discussed above in form and function, except that the corner junction cover 210 is angled to cover the full corner junction 26 and can have a ball opening 70 defined in the cover 210 as shown. The track 200 discussed above extends to the ball opening 70 in the cover 210 such that the ball can be inserted in the opening 70 and roll along the track 200 as discussed above.

Figure 10:
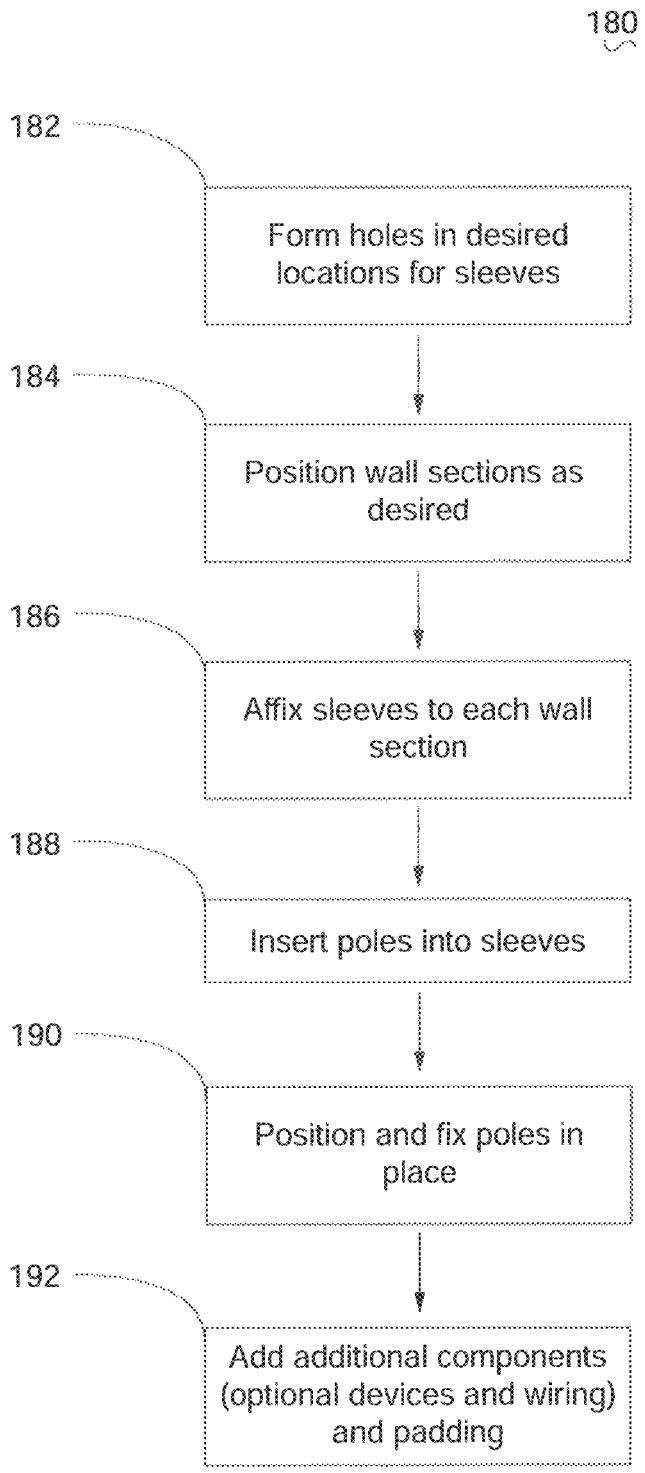
FIG. 10 is a flow chart relating to the steps for installing a backstop and netting system, according to one embodiment.

In use, the various system embodiments disclosed or contemplated herein can be installed in the following fashion, as captured in the flow chart of FIG. 10 according to one implementation. First, holes to receive the sleeves 18 are formed at the site (block 182). In certain implementations, the holes are formed using an auger. Then, the wall sections 14 can be positioned in their desired locations at the site (block 184). According to some implementations, the wall sections 14 can be positioned using a skid loader with a sling (a known fabric resilient attachment member) or similar construction machine and related attachment member. The sleeves 18 can be positioned in the holes and attached to each wall section 14 such that the desired number of wall sections 14 (for the desired size and configuration of the backstop 12) are coupled to each other via the sleeves 18 as shown in exemplary fashion in FIGS. 4A and 4B (block 186). More specifically, in the specific embodiment as disclosed herein, pins (not shown) are inserted through the attachment structures 66 of the wall section 14 and the attachment structures of the sleeve 18 as discussed above, thereby coupling the sleeve 18 to the wall 14. Further, according to certain implementations, the pins (not shown) can be used to attach the sleeves 18 to the wall sections 14 by starting at one specific sleeve 18 along the backstop 12, attaching that sleeve 18 to the adjacent wall sections 14, and then progressively moving outward from that sleeve 18 to each adjacent sleeve 18 and performing the same attachment steps thereto, adjusting the positioning of each wall section 14 as needed along the way. In this implementation, once all of the wall sections 14 are attached to their respective sleeves 18, all the wall sections 14 can be evaluated further to ensure that each section 14 is positioned correctly (including being sighted straight, plumb, and level).

In certain embodiments, each sleeve 18 is inserted into its hole such that about 10 feet of the sleeve 18 is positioned in the ground. Alternatively, the depth of the sleeve 18 in the ground can vary from about four feet to about 20 feet. In certain embodiments, each sleeve 18 can be retained in place using temporary mechanisms such as wedges. Further, according to these embodiments, each sleeve 18 can be backfilled. For example, the sleeve 18 can first be backfilled with some gravel and then with concrete. Alternatively, the sleeve 18 can be backfilled with any materials.

One optional step that can be performed at various points in the installation process (before or after various of the steps as set forth herein) is the preparation of the site for installation. That is, the site can be prepared as needed, including, for example, grading the land at the site, setting a reference elevation pin, marking the ground as needed for placement of components, including poles 16, and any other necessary/desirable preparation steps.

Once the wall sections 14 and sleeves 18 are positioned as desired, the poles 16 are then inserted into the sleeves 18 (block 188). According to one embodiment, a crane can be used to place the poles 16 in the sleeves 18.

Once the poles 16 are inserted as described above, the poles 16 can be positioned and fixed in place in relation to the sleeves 18 (block 190). More specifically, in certain embodiments, the set screws 110, 112 can be used to position each pole 16 to ensure it is level and then can be fixed in place using the same screws 110, 112. More specifically still, any additional backfill or materials can be used to fill the aforementioned augered holes; additionally, concrete pad 24 can be poured (e.g., on the spectator side of backstop 12), and turf can be installed (e.g., on the field of play side of backstop 12) such that multiple components of system 10 are collocated and fixed (block 190).

Once the backstop 12 is permanently implanted as discussed above, any desired additional components as discussed above (including flexible conduits) and removable padding can be added (block 192). More specifically, any of the optional devices (such as the various optional devices that can be attached to the brackets 152 as discussed above, including cameras, speakers, a radar gun, TV monitors, ball/strike visual indicators, outlets, phone charging stations, ribbon boards, pathway egress lighting, and/or emergency lighting or signage) can be attached to any one or more of the wall sections 14 and/or any optional wiring can be positioned within the walls 14 (such as through the conduits 86, for example) as needed/desired. Further, the removable padding sections can be attached to the field side 32 of each wall section 14. Many of the optional devices and optional wiring can be interchanged with other components that can be attached to the structure. Thus, as technology changes or maintenance is needed, these devices and wiring can be easily interchanged or updated to accommodate new or different devices and/or wiring. Because the padding sections are removeable, the above-listed components can be easily accessed without needing to modify or remove any concrete or turf component, as well as without needing to remove externally mounted conduits or wiring.

In certain optional embodiments, one or more of the optional devices or components can be attached to one or more of the poles 16 at any time in the installation process prior to inserting those poles 16 through the sleeves 18 and into the holes in the ground. More specifically, it could be beneficial in some embodiments to attach such optional devices/components to one or more of the brackets 152 on the poles 16 while the poles 16 are still laying on the ground or otherwise accessible prior to insertion into the target pole holes.

Another step that can be performed at various points in the installation is the addition of the netting 120. That is, the netting 120 can be attached to the attachment tracks 122 on the corresponding poles 16 before the poles 16 are installed, or the netting 120 can be attached after installation.

The modular nature of the various backstop and netting system 10 embodiments herein can result in various benefits for the installation process and the resulting backstop 12. More specifically, the modular nature of the system 10 and the predetermined dimensions of the various components create significant time-saving and cost-saving efficiencies during installation. For example, the predetermined length of the wall sections 14 and thus the distance between the poles 16 results in the ability to provide netting 120 have a predetermined width to fit therebetween. Further, the ability to provide various sizes (lengths) of wall sections results in the ability to have various corresponding netting sizes as well, providing some flexibility when deciding which backstop 12 size to install without impacting the installation efficiency. In addition, the predetermined dimensions eliminate any need to do any measurements or size modifications onsite, thereby allowing for all components to be premade and thus allowing installers to get the exact parts (of specific dimensions) needed and know exactly where the pole holes need to be formed on the target site—thereby reducing excess material. As such, the system 10 embodiment herein result in a systemization of the installation process with as much work being performed in the factory (and less at the installation site) as possible.

Although the various embodiments have been described with reference to preferred implementations, persons skilled in the art will recognize that changes may be made in form and detail without departing from the spirit and scope thereof. In other words, the invention may take many forms and embodiments. The foregoing examples are but a few of those. Because each owner may have particular needs and each site has particular characteristics, the sizes of the various components herein, materials that the components are made of, power means, fastening and attachment devices, and the like may vary—and not depart from aspects of the various embodiments herein. To give some sense of some options and alternatives, a few examples are given below.

For example, poles 16 have been illustrated as generally square in cross-section, but this illustration is provided as an exemplary configuration and is not intended to be limiting. Any pole 16 embodiments can be generally circular in cross-section or have another cross-sectional configuration.

Further, the sizes and specific configurations of the wall sections 14 can vary from the exemplary embodiments described above. For example, the various openings and internal components of the wall sections 14 can vary based on the needs and variations of a specific site. Further, the wall section 14 dimensions can vary based on the desired overall size and configuration of the backstop 12. Similarly, the related poles 16 and sleeves 18 and related components can also vary in size and dimension accordingly.

In addition to the exemplary embodiments of the attachment track 122 and attachment device 140 as described above, other attachment structures and/or devices can be incorporated to accomplish the same functions as described above to deploy and retract the netting 120. For example, the attachment track 122 can be formed into the sides of the poles 16, rather than being a separate structure attached thereto. Alternatively, the track 122 can have a different configuration than the exemplary configuration described above. Similarly, the attachment device 140 can take on any of a variety of configurations of separate components that can be attachable to the netting 120 and slide along the attachment track 122.

In certain embodiments, in addition to the exemplary materials discussed above, the various components herein can be made of any number of different known materials that can be used for similar sports field structures.

According to some implementations, in addition to any specific exemplary processes discussed above, any known fabrication and processing methods and techniques—such as, for example, anodizing and powder coating any one or more of the components herein for weather hardiness—can also be incorporated into the various embodiments herein.

The various exemplary system embodiments disclosed or contemplated herein can not only be used for baseball and softball fields, but also for any other type of sports field or venue, including soccer, American football, etc.

With respect to exemplary installation method 180 described above, it is important to note that there could be more, fewer, or different steps, or the steps can be performed in a different order, and not depart from various aspects of the embodiments herein. For example, in certain alternative implementations, the sleeves 18 could be inserted into the holes formed in the ground before the wall sections 14 are placed in their desired positions. Similarly, other aspects of the method could include inserting the poles 16 in the sleeves 18 prior to positioning or attaching the wall sections 14.

While the various systems described above are separate implementations, any of the individual components, mechanisms, or devices, and related features and functionality, within the various system embodiments described in detail above can be incorporated into any of the other system embodiments herein.

The terms "about" and "substantially," as used herein, refers to variation that can occur (including in numerical quantity or structure), for example, through typical measuring techniques and equipment, with respect to any quantifiable variable, including, but not limited to, mass, volume, time, distance, wave length, frequency, voltage, current, and electromagnetic field. Further, there is certain inadvertent error and variation in the real world that is likely through differences in the manufacture, source, or precision of the components used to make the various components or carry out the methods and the like. The terms "about" and "substantially" also encompass these variations. The term "about" and "substantially" can include any variation of 5% or 10%, or any amount—including any integer—between 0% and 10%. Further, whether or not modified by the term "about" or "substantially," the claims include equivalents to the quantities or amounts.

Numeric ranges recited within the specification are inclusive of the numbers defining the range and include each integer within the defined range. Throughout this disclosure, various aspects of this disclosure are presented in a range format. It should be understood that the description in range format is merely for convenience and brevity and should not be construed as an inflexible limitation on the scope of the disclosure. Accordingly, the description of a range should be considered to have specifically disclosed all the possible sub-ranges, fractions, and individual numerical values within that range. For example, description of a range such as from 1 to 6 should be considered to have specifically disclosed sub-ranges such as from 1 to 3, from 1 to 4, from 1 to 5, from 2 to 4, from 2 to 6, from 3 to 6 etc., as well as individual numbers within that range, for example, 1, 2, 3, 4, 5, and 6, and decimals and fractions, for example, 1.2, 3.8, 1½, and 4¾ This applies regardless of the breadth of the range. Although the various embodiments have been described with reference to preferred implementations, persons skilled in the art will recognize that changes may be made in form and detail without departing from the spirit and scope thereof.

What is claimed is:

1. A backstop and netting system comprising:

(a) at least one wall section comprising:

(i) a first side comprising at least one access opening defined therein;

(ii) a second side;

(iii) a wall cavity defined by the first and second sides; and (iv) a netting receiving space defined within the wall cavity;

(b) at least two poles, wherein each of the at least two poles comprises:

(i) at least one attachment track disposed along one side of the pole; and (ii) at least one attachment device slidably attached to the at least one attachment track;

(c) at least two coupling sleeves, where each of the at least two coupling sleeves comprises:

(i) a first wall attachment component disposed on a first side of the coupling sleeve;

(ii) a second wall attachment component disposed on a second side of the coupling sleeve; and (iii) a pole receiving cavity defined within the coupling sleeve; and (d) at least one netting releasably attachable along opposing ends of the netting to the at least one attachment devices.

2. The backstop and netting system of claim 1, wherein the at least one netting is moveable between a deployed position and a retracted position in which the netting is disposed within the netting receiving space.

3. The backstop and netting system of claim 1, further comprising a concrete pad disposed on the second side.

4. The backstop and netting system of claim 1, further comprising a turf attachment structure disposed on the first side.

5. The backstop and netting system of claim 1, wherein each wall cavity comprises at least one junction box and at least one conduit attached to the junction box.

6. The backstop and netting system of claim 1, wherein the at least one wall section comprises at least one padding section.

7. The backstop and netting system of claim 1, wherein the at least one wall section comprises at least two openings providing access to the wall cavity therein.

8. The backstop and netting system of claim 1, wherein each sleeve comprises at two sets of adjustable screws.

9. The backstop and netting system of claim 1, wherein each pole further comprises a pulley associated with each attachment track.

10. The backstop and netting system of claim 1, further comprising a bracket disposed on the at least two poles.

11. The backstop and netting system of claim 1, wherein the backstop comprises at least one corner junction formed by two at least one wall sections.

12. The backstop and netting system of claim 11, wherein the at least one corner junction comprises a ball return opening including a ball track and a blocking structure.

13. The backstop and netting system of claim 1, further comprising at least one video board disposed on at least one of the at least two poles or the at least one wall section.

14. A method of installing a backstop and netting system at a site, the method comprising:

positioning at least one wall section having first and second sides, generally opposite ends, and an internal space contained therebetween and therein at a desired location at the site;

forming at least two holes in a ground surface in relation to the desired location of the at least one wall section;

attaching each of at least two coupling sleeves to an end of the at least one wall section such that the coupling sleeve is at least partially disposed within one of the at least two holes and at least partially extends above the ground surface;

inserting each of at least two poles into an elongate cavity formed by the one of the at least two coupling sleeves when disposed within the holes;

positioning each of the poles in a desired position in relation to the coupling sleeve; and fixing each of the poles in the desired position such that each pole is at least partially disposed within one of the at least two holes and at least partially extends above the ground surface.

15. The method of claim 14, further comprising adding a netting to the system.

16. The method of claim 15, further comprising adjusting the positioning of the netting such that the netting covers a desired area.

17. The method of claim 14, further comprising pouring concrete to form a concrete pad on a side of the backstop.

18. The method of claim 14, further comprising attaching additional accessories or objects to at least one bracket attached to the poles.

19. The method of claim 14, further comprising preparing the site for installation, wherein the site includes land.

20. The method of claim 19, wherein preparing the site for installation comprises:

grading the land at the site;

setting a reference elevation pin; and marking the land as needed for placement of components.

* * * * *